US010866061B2

(12) United States Patent
Anstett et al.

(10) Patent No.: US 10,866,061 B2
(45) **Date of Patent: *Dec. 15, 2020**

(54) MULTI-AXIS FIREARM FOREGRIP

(71) Applicant: TJA DESIGN LLC, Lake Zurich, IL (US)

(72) Inventors: Todd J. Anstett, Island Lake, IL (US); Jason Scott Stuart, Gilbert, AZ (US)

(73) Assignee: TJA Design LLC, Lake Zurich, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/649,730

(22) Filed: Jul. 14, 2017

(65) Prior Publication Data

US 2017/0314889 A1 Nov. 2, 2017

Related U.S. Application Data

(63) Continuation of application No. 14/704,338, filed on May 5, 2015, now Pat. No. 9,709,356.

(Continued)

(51) Int. Cl.
*F41C 23/16* (2006.01)

(52) U.S. Cl.
CPC ..... *F41C 23/16* (2013.01)

(58) Field of Classification Search
CPC ..... F41C 23/16

(Continued)

(56) References Cited

U.S. PATENT DOCUMENTS 86,173 A * 1/1869 Maynard ..... F16C 11/0661 403/123
179,012 A * 6/1876 Graham ..... A47C 9/105 108/128

(Continued)

FOREIGN PATENT DOCUMENTS

| | | |
|---|---|---|
| CN | 2687476 Y | 3/2005 |
| EP | 1921499 A1 | 5/2008 |
| EP | 2322989 A2 | 5/2011 |

OTHER PUBLICATIONS

Cardan Shaft Definition (https://www.merriam-webster.com/dictionary/Cardan%20shaft) accessed [Apr. 1, 2018 12:36:32 PM].*

(Continued)

*Primary Examiner* — Michelle Clement
(74) *Attorney, Agent, or Firm* — Jansson Munger McKinley & Kirby Ltd.

(57) ABSTRACT

A multi-axis firearm foregrip which is highly adjustable and which enables a firearm to be held or supported in a position which is ergonomic for the user or appropriate for use of the firearm. The foregrip may be rapidly adjusted to a selected one of many different positions as deemed appropriate by the user to enable optimal use of the firearm. The foregrip comprises a mount, a handle and a joint. The mount may be engageable to the firearm, for example to a rail system of the firearm. The handle is adjacent to the mount. The joint engages the handle to the mount and allows for handle movement relative to the mount. In embodiments, the foregrip utilizes a ball-and-socket joint which enables swiveling movement of the handle relative to the mount providing a wide range of handle adjustment before the handle is held at the selected position by the foregrip.

10 Claims, 19 Drawing Sheets

Related U.S. Application Data

(60) Provisional application No. 61/989,301, filed on May 6, 2014.

(58) Field of Classification Search
USPC ..... 42/72
See application file for complete search history.

(56) References Cited

U.S. PATENT DOCUMENTS 271,251 A * 1/1883 Leerbech et al. ..... F41A 23/14 42/94
505,778 A * 9/1893 Rouse ..... B29C 45/2618 249/59
575,529 A * 1/1897 Stephens ..... B62H 1/06 248/171
579,529 A * 3/1897 Bauercamper ..... E06B 7/18 49/320
583,656 A * 6/1897 McGrady ..... B62H 1/06 248/169
673,262 A * 4/1901 Hine ..... F16M 11/14 248/181.2
713,114 A * 11/1902 La Force ..... A45B 5/00 135/66
721,425 A * 2/1903 Clyde ..... F41A 23/18 248/170
807,857 A 12/1905 Palmenberg
1,185,642 A * 6/1916 Emerson ..... E04H 15/46 108/41
1,226,554 A * 5/1917 Mante ..... A47B 3/12 108/128
1,295,688 A * 2/1919 Butler ..... F41A 23/08 42/94
1,333,432 A 3/1920 Maier
1,355,660 A * 10/1920 Gore ..... F41A 17/56 42/94
1,382,409 A * 6/1921 Butler ..... F41A 23/08 248/166
1,532,195 A 4/1925 Morrison
1,560,458 A 11/1925 Wise
1,580,406 A * 4/1926 Browning ..... F41A 23/08 42/94
1,894,456 A 1/1933 Zerk
2,386,802 A * 10/1945 Johnson, Jr. ..... F41A 23/00 42/71.01
2,420,267 A * 5/1947 Sefried ..... F41A 23/08 403/157
2,436,349 A * 2/1948 Adams ..... F41A 23/08 124/29
2,445,489 A * 7/1948 Mangold ..... A47C 9/105 108/128
2,464,500 A 3/1949 Graham
2,489,283 A * 11/1949 Garand ..... F41A 23/08 42/94
2,542,137 A * 2/1951 Hanson ..... A47F 7/24 126/30
2,670,228 A 2/1954 Pagliuso
2,763,456 A 9/1956 Beer
2,807,904 A * 10/1957 Kreske ..... F41A 23/08 42/94
2,898,137 A * 8/1959 Kreske ..... F41A 23/08 242/597.3
2,928,686 A 3/1960 Newkirk
2,984,249 A 5/1961 Sears, Jr. et al.
3,235,997 A * 2/1966 Stoner ..... F41A 23/08 42/94
3,319,982 A 5/1967 Schwartz
3,327,422 A * 6/1967 Harris ..... F41A 23/08 42/94
3,464,664 A * 9/1969 Nugent ..... A47G 25/0664 211/172
3,539,234 A 11/1970 Rapata
3,575,369 A 4/1971 Tetlow
D222,118 S * 9/1971 Nakatani ..... D16/244
3,618,885 A * 11/1971 Muller ..... G10G 5/00 211/196
3,632,073 A 1/1972 Nakatani
3,749,431 A * 7/1973 Schmid ..... B60S 1/24 403/122
4,066,231 A 1/1978 Bahner et al.
4,074,881 A * 2/1978 Bickford ..... A47C 7/004 248/170
4,121,799 A 10/1978 Michio
4,215,839 A * 8/1980 Gibran ..... F16M 11/16 248/170
4,357,651 A 11/1982 Mayer
4,409,111 A * 10/1983 Holmes ..... C10M 111/04 508/130
4,438,612 A 3/1984 Bernard et al.
4,520,983 A 6/1985 Templeman
4,545,660 A * 10/1985 Rudolf ..... F16M 13/00 248/171
4,565,345 A 1/1986 Templeman
4,570,887 A * 2/1986 Banister ..... F16M 11/041 248/187.1
4,580,483 A * 4/1986 Garbini ..... F41A 23/12 248/165
4,625,620 A * 12/1986 Harris ..... F41A 23/08 42/94
4,640,481 A * 2/1987 Kohno ..... F16M 11/10 248/126
4,666,118 A 5/1987 Busche
4,697,742 A 10/1987 Schnipke
4,770,382 A 9/1988 Lehti
4,776,124 A * 10/1988 Clifton ..... F41A 23/08 42/94
4,795,118 A 1/1989 Kosugi et al.
4,807,837 A * 2/1989 Gawlik ..... A61M 5/1415 211/196
4,903,425 A * 2/1990 Harris ..... F16M 13/02 42/94
4,929,973 A * 5/1990 Nakatani ..... F16M 11/041 248/177.1
4,974,802 A 12/1990 Hendren
4,979,709 A * 12/1990 Ishikawa ..... F16M 11/041 248/187.1
4,984,090 A * 1/1991 Sasaki ..... H04N 5/2251 348/376
4,986,503 A 1/1991 Kabat
5,029,407 A 7/1991 Kirkpatrick
5,048,646 A 9/1991 Carlsson
5,071,279 A 12/1991 Rutstroem
5,072,907 A 12/1991 Vogt
5,073,417 A 12/1991 Bowerman
5,074,188 A 12/1991 Harris
5,081,478 A * 1/1992 Hayashida ..... F16M 11/10 248/187.1
5,081,782 A 1/1992 Wright
5,194,678 A 3/1993 Kramer
5,222,705 A * 6/1993 Gibran ..... F16M 11/04 248/170
5,249,766 A 10/1993 Vogt
5,345,706 A 9/1994 Brown
5,384,609 A * 1/1995 Ogawa ..... F16M 11/28 396/419
5,417,002 A 5/1995 Guerra
5,421,549 A * 6/1995 Richards ..... F16M 11/10 248/163.2
5,425,315 A * 6/1995 Huggins ..... A47B 3/00 108/115
5,438,786 A * 8/1995 Hilderbrand ..... F41A 23/14 248/171
5,501,684 A * 3/1996 Schlapfer ..... A61B 17/60 403/90
5,547,162 A * 8/1996 Sobolewski ..... F41B 5/14 124/88
5,660,363 A 8/1997 Maglica
5,746,407 A * 5/1998 Nakatani ..... F16M 11/18 248/168
5,852,892 A * 12/1998 Bilgeri ..... F41A 23/08 42/94

(56) References Cited

U.S. PATENT DOCUMENTS 5,857,279 A * 1/1999 de Oliveira Masina ..... F41C 23/10 42/71.01
5,860,728 A 1/1999 Maglica
5,903,995 A 5/1999 Brubach
5,930,933 A * 8/1999 Schleicher ..... F41A 23/16 42/94
5,946,842 A 9/1999 Nyzell et al.
6,017,010 A * 1/2000 Cui ..... F16C 11/106 248/181.1
6,050,531 A * 4/2000 Wilcox ..... A47B 19/002 248/188.5
6,289,622 B1 * 9/2001 Desch, Jr. ..... F41A 23/10 42/94
6,293,041 B2 * 9/2001 Weaver ..... F41A 23/02 42/94
6,305,116 B1 * 10/2001 Parker ..... F41A 23/04 42/94
6,315,256 B1 * 11/2001 Tolar ..... F41A 23/00 248/230.4
6,397,507 B1 * 6/2002 Marshall ..... F41C 23/16 42/106
6,487,807 B1 * 12/2002 Kopman ..... F41A 23/12 42/72
6,539,660 B1 * 4/2003 Yeargin ..... F41A 23/10 42/94
6,588,719 B1 * 7/2003 Tubach ..... F16C 11/106 248/282.1
6,629,380 B2 * 10/2003 Yeargin ..... F41A 23/10 42/94
6,658,781 B1 * 12/2003 Bowen ..... F41C 23/12 42/71.02
6,763,627 B1 * 7/2004 Kaempe ..... F41A 23/10 42/94
6,773,110 B1 * 8/2004 Gale ..... F16M 13/04 348/211.4
6,773,172 B1 * 8/2004 Johnson ..... F16M 11/041 248/187.1
6,827,319 B2 * 12/2004 Mayr ..... F16M 11/041 248/187.1
6,843,015 B2 * 1/2005 Sharp ..... F41A 23/10 211/203
D506,521 S * 6/2005 Strahan ..... D22/108
7,021,592 B2 4/2006 Brandes
7,077,582 B2 7/2006 Johnson
7,100,318 B1 * 9/2006 Beltz ..... F41A 23/06 248/274.1
7,191,557 B2 3/2007 Gablowski et al.
7,243,454 B1 * 7/2007 Cahill ..... F41C 23/12 42/72
7,320,555 B2 1/2008 Chang et al.
7,421,817 B2 * 9/2008 Larsson ..... F41G 1/35 42/127
7,430,828 B2 * 10/2008 Munst ..... F41G 11/003 42/72
7,434,344 B2 10/2008 Golan
7,520,083 B2 * 4/2009 Dextraze ..... F41G 1/393 42/124
7,584,568 B1 9/2009 Brownlee
7,614,174 B1 11/2009 Beltz
7,676,977 B1 * 3/2010 Cahill ..... F16M 11/16 248/168
7,676,979 B1 * 3/2010 Mertz ..... F41A 23/08 42/71.01
7,698,847 B2 4/2010 Griffin
7,793,454 B1 9/2010 Beltz
7,797,875 B1 * 9/2010 Carrier ..... F41G 11/003 211/85.7
7,823,316 B2 * 11/2010 Storch ..... F41G 11/003 42/127
7,891,887 B1 2/2011 Wu
7,980,017 B2 * 7/2011 Harman, III ..... F41C 27/00 42/94
7,987,623 B1 * 8/2011 Moody ..... F41A 23/08 42/71.01
8,028,457 B2 10/2011 Moody et al.
8,156,678 B2 * 4/2012 Hoel ..... F41G 11/003 42/124
8,225,543 B2 7/2012 Moody et al.
8,267,361 B1 9/2012 Dordlick
8,276,306 B2 * 10/2012 Lickteig ..... F41A 23/06 211/64
8,341,866 B1 * 1/2013 Gaddini ..... F41G 11/003 42/71.01
8,359,702 B2 * 1/2013 Powell, Jr. ..... B60S 1/24 15/250.27
8,393,104 B1 * 3/2013 Moody ..... F41C 23/14 42/71.01
8,397,421 B2 3/2013 Ding et al.
8,413,398 B1 * 4/2013 Allred ..... F16G 11/06 248/181.1
8,418,973 B2 4/2013 Liu et al.
8,424,823 B2 * 4/2013 Fadler ..... A61B 8/0825 248/181.1
8,429,843 B2 4/2013 Yan
8,438,773 B2 * 5/2013 Carlson ..... F41G 11/008 42/125
8,505,229 B2 * 8/2013 Savoy ..... F41G 11/003 42/128
8,601,734 B1 12/2013 Hopkins et al.
8,753,031 B2 * 6/2014 Stefan ..... A61B 90/50 248/181.1
8,820,210 B2 9/2014 Melville
8,904,693 B1 * 12/2014 Beltz ..... F41A 23/10 42/72
8,910,407 B2 12/2014 Singh
8,960,066 B2 2/2015 Gomez
9,206,941 B2 12/2015 Smith et al.
9,303,940 B2 4/2016 Bonelli et al.
9,573,268 B2 2/2017 Azhocar
9,709,356 B1 7/2017 Anstett et al.
2003/0192223 A1 10/2003 Sharp
2003/0205653 A1 * 11/2003 Peterson ..... A01M 31/02 248/286.1
2003/0218108 A1 * 11/2003 Werner ..... F16M 11/041 248/187.1
2004/0060222 A1 * 4/2004 Oz ..... F41G 1/35 42/146
2004/0144010 A1 7/2004 Golan
2005/0041966 A1 * 2/2005 Johnson ..... F16M 11/041 396/428
2005/0151040 A1 7/2005 Hsu
2005/0188588 A1 * 9/2005 Keng ..... F41A 23/10 42/72
2005/0207749 A1 9/2005 Barker et al.
2005/0241206 A1 11/2005 Teetzel et al.
2005/0241211 A1 * 11/2005 Swan ..... F41G 11/003 42/124
2005/0242250 A1 11/2005 Keng et al.
2006/0010748 A1 * 1/2006 Stoner ..... F41C 27/00 42/71.01
2006/0150467 A1 7/2006 Poulin et al.
2006/0156609 A1 * 7/2006 Kim ..... F41G 11/003 42/124
2006/0239677 A1 * 10/2006 Friedrich ..... F16M 11/043 396/419
2006/0248774 A1 * 11/2006 Pierce ..... F41A 23/10 42/94
2007/0271834 A1 * 11/2007 Keng ..... F41G 11/003 42/124
2008/0052979 A1 * 3/2008 Lee ..... F41A 23/04 42/94
2008/0072471 A1 3/2008 Keng
2009/0056192 A1 3/2009 Oz
2009/0126250 A1 5/2009 Keng
2009/0193702 A1 8/2009 Lin
2009/0241396 A1 10/2009 McManus
2009/0313873 A1 12/2009 Roth

(56) References Cited

U.S. PATENT DOCUMENTS

| | | | | |
|---|---|---|---|---|
| 2010/0005696 | A1 | 1/2010 | Moody et al. | |
| 2010/0012107 | A1 | 1/2010 | Bednar | |
| 2010/0107467 | A1* | 5/2010 | Samson | F41G 11/003 42/127 |
| 2010/0132239 | A1 | 6/2010 | Moody et al. | |
| 2010/0146836 | A1 | 6/2010 | Moody et al. | |
| 2010/0162611 | A1* | 7/2010 | Samson | F41G 1/18 42/125 |
| 2010/0205795 | A1* | 8/2010 | Moody | F41A 23/08 29/428 |
| 2010/0212203 | A1 | 8/2010 | McGarry | |
| 2010/0263256 | A1* | 10/2010 | Spinelli | F41G 11/003 42/124 |
| 2011/0047850 | A1* | 3/2011 | Rievley | F41C 23/16 42/72 |
| 2011/0047851 | A1* | 3/2011 | Mock | F41C 23/16 42/72 |
| 2011/0047855 | A1* | 3/2011 | Wong | F41G 11/002 42/124 |
| 2011/0099873 | A1* | 5/2011 | Bentley | F41C 23/16 42/71.01 |
| 2012/0042730 | A1 | 2/2012 | Johnson et al. | |
| 2012/0272557 | A1* | 11/2012 | Yan | F41C 23/12 42/69.01 |
| 2013/0193288 | A1 | 8/2013 | Congdon | |
| 2013/0205636 | A1 | 8/2013 | Shull | |
| 2014/0013641 | A1 | 1/2014 | Warburton et al. | |
| 2014/0053447 | A1 | 2/2014 | Singh | |
| 2014/0082987 | A1 | 3/2014 | Boll et al. | |
| 2014/0115940 | A1 | 5/2014 | Bonelli et al. | |
| 2015/0023656 | A1 | 1/2015 | Moody et al. | |
| 2015/0121741 | A1 | 5/2015 | Bowman | |
| 2015/0215690 | A1 | 7/2015 | Simpson et al. | |
| 2015/0300775 | A1 | 10/2015 | Combs | |
| 2015/0337890 | A1 | 11/2015 | Faccioli et al. | |

OTHER PUBLICATIONS

English-language machine translation of CN2687476, dated Mar. 23, 2005, Wu et al.
Sportys Catalog excerpt May 2013.
FAB Defense, T-FL 7-Position Tactical Folding Grip, www.fab-defense.com, www.themakogroup.com, Copyright 2015.
FAB Defense, T-FS Horizontal "Side-to-Side" Folding Foregrip, www.fab-defense.com, 2015.
The Mako Group, Foregrips, www.themakogroup.com, Copyright 2015.
YRS, Inc., FVG 58 Five Position Folding Foregrip and other foregrips, www.yrsinc.com, downloded Sep. 17, 2017.
Mission First Tactical LLC, React Folding Grip, www.missionfirsttactical.com/Products/Vertical-Grips/REACT-Folding-Grip, www.midwayusa.com, Copyright 2010.
Advance Technology International, forend pistol grip, www.atioutdoors.com/rifles/ar-15/grips/forend-pistol-grip, www.midwayusa.com, Copyright 2016.
Leapers, Inc., UTG MNT-GRP002SQ, www.leapers.com, downloaded Oct. 14, 2017.
B & T AG, BT-211151 Folding Vertical Foregrip and other foregrips, www.bt-ag.ch, downloaded Sep. 17, 2017.
Botach, Foregrips, www.botach.com, downloaded Sep. 19, 2017.
Troy Industries, Inc., CQB Vertical Grip, www.troyind.com/products/grip-cqb-vertical-polymer-blk, Copyright 2018.
Ergo Grips, 2015 Catalog excerpts.
Ergo Grips, 2018 Catalog.
Daniel Defense, Inc., Foregrips, www.danieldefense.com, downloaded Oct. 21, 2017.
Magpul Industries Corp., RVG Rail Vertical Grip, www.magpul.com, Aug. 2014.
Samson Manufacturing Corp., Evolution Vertical Grip, www.samson-mfg.com/product/Evolution-Grip-VG02.html, Mar. 2014.
American Built Arms Company, SBR Vertical Foregrip, www.abarms.com, Jul. 2014.
Fortis Manufacturing, Shift Vertical Grip KeyMod, www.fortismfg.com/grips/keymod/ar15-fortis-shift-vertical-grip-keymod, 2017.
Magpul Industries Corp., 2016 Catalog, Copyright 2014.
Midway USA, Foregrips, www.midwayusa.com, 2014.
Brownells, Foregrips, www.brownells.com, downloaded Sep. 19, 2017.
Engineered Accessories, bipods grips handles adaptors, www.handgrips.com, downloaded Sep. 19, 2017.
GT Distributors, Foregrips/Rails, www.gtdist.com, downloaded Sep. 19, 2017.
Cheaper Than Dirt, Foregrips, www.cheaperthandirt.corn, downloaded Sep. 19, 2017.
Iron Eagle Tactical, Foregrips, www.ironeagle.com, downloaded Sep. 19, 2017.
Extreme Tactical, Foregrips, www.extremetactical.com, downloaded Sep. 19, 2017.
Optics Planet, Foregrips, www.opticsplanet.com, downloaded Sep. 19, 2017.
Zahall, Foregrips, www.zahall.org, downloaded Sep. 19, 2017.
Wing Tactical, Foregrips, www.wingtactical.com, Copyright 2017.
Crimson Trace MVF-515R Foregrip, www.tacticalgear.com, downloaded Oct. 15, 2017.
FAB Defense, Rubberized Stout Foregrip, www.botach.com, downloaded Oct. 15, 2017.
FAB Defense, Foregrips, www.fab-defense.com, downloaded Oct. 15, 2017.
Mounting Solutions Plus, FAR 15 Vertical Grips/Foregrips, www.mountsplus.com, downloaded Sep. 19, 2017.
ZFI, Inc. Foregrips, www.zfi-inc.com, downloaded Sep. 19, 2017.
Firearms News, 8 Great New Gun Accessories for 2016, www.firearmsnews.com, Feb. 18, 2016.

* cited by examiner

MULTI-AXIS FIREARM FOREGRIP

CROSS REFERENCE TO RELATED APPLICATIONS

This application is a continuation of U.S. patent application Ser. No. 14/704,338, filed May 5, 2015, now U.S. Pat. No. 9,709,356, issued Jul. 18, 2017, which claims the benefit of U.S. Provisional Patent Application Ser. No. 61/989,301 filed May 6, 2014, the entire content of said applications being incorporated herein by reference for continuity of disclosure.

FIELD

The field relates to grips and, more specifically, to grips for use with firearms.

BACKGROUND

A foregrip is a well-known original or accessory component for use with rifles and other types of firearms. A foregrip means or refers to a type of forestock which may be configured for user gripping and which may be located toward the front end of a firearm. A foregrip can provide for a more comfortable and ergonomic hold of a firearm, potentially reducing user fatigue and resulting in more controllable fire. A foregrip can also improve the handling characteristics of the firearm and can serve to counter the effect of recoil. Yet another benefit of a foregrip is that the foregrip can be cooler to the touch than a standard forestock making the firearm easier to handle as the firearm generates heat during use.

A limitation of existing foregrips is that such foregrips are not optimally ergonomic across a full spectrum of potential users and potential situational uses of the firearm of which the foregrip is a part. Existing foregrips are not optimally ergonomic because such foregrips are either an immovable component of the firearm or have a limited range of adjustability. These limitations make it more difficult to optimally fit the firearm to the user. An improperly fitted firearm can result in a sub-optimal hold point and aiming of the firearm.

Proper ergonomic fitting of a firearm to the user is a challenge because, of course, each user has unique ergonomic needs based on the user's physical characteristics. A foregrip fitted for one user and which provides for an optimal firearm hold point for that user may be completely unsuitable for another user with completely different physical characteristics.

It is further apparent that different situational uses of the firearm can require that the firearm be uniquely configured to optimally fit the user for the given mission. For example, certain situational uses of a firearm can require that the user adopt a "bladed" shooting stance. In a bladed shooting stance, the user's forward facing shoulder and side is toward the target providing for both a more limited user silhouette and a stable standing shooting position. The user's forward arm is typically below the firearm when in a bladed shooting stance.

In yet other situational uses of the firearm, the user may adopt a more "squared" shooting stance. In a squared stance, the user's chest faces forward toward the target. This squared shooting stance is used, for example, when the user's chest and torso is protected by body armor such as ballistic plates. In such situations, the user is optimally protected, not by adopting a more limited silhouette, but by keeping the body armor toward the target. The body armor is bulky. The body armor on the user's chest can force the user's arm holding the foregrip or forestock sideways and laterally outward from the firearm. A foregrip suitable for an optimal hold point in a bladed shooting stance may not provide an optimal hold point in a squared shooting stance because of the different positions of the user's body for each shooting stance.

It is also apparent that firearms are routinely used under the most extreme and rigorous conditions. Any foregrip component or foregrip accessory contemplated for use with a firearm must be robust and capable of reliable and simple operation under any and all conditions in which the firearm will be used.

It would be an improvement in the art to provide a foregrip which would be an improvement over existing foregrips, which would facilitate optimal fitting of the firearm to the user based on the unique physical characteristics of the user, which would adapt the firearm for different situational uses and which would be reliable and simple to use.

SUMMARY

A multi-axis firearm foregrip, embodiments of which are described herein. Foregrip embodiments may be used in connection with any type of firearm for which a foregrip would be deemed advantageous. Embodiments of the foregrip are highly adjustable. Such adjustability enables the user to optimally fit the firearm to the user's unique physical characteristics thereby enabling a standardized firearm to be customized for the user. The adjustability of the foregrip also enables the firearm to be adapted for different situational uses and different shooting stances which may be required for such uses. In other examples of situational uses, the foregrip may be rapidly adjusted for use as a hand hold or may be rapidly adjusted for use as a monopod to support the firearm on a surface. In the embodiments described herein, the foregrip is reliable and simple to use under rigorous and demanding conditions.

In embodiments, a multi-axis firearm foregrip comprises a mount, a handle and a joint. The mount may be engageable to the firearm. For example, the mount could engage with a rail system which is attached to, or is a component of, the firearm. Attachment to an elongate rail system could provide fore and aft movement of the foregrip with respect to the firearm permitting adjustment of the mount to a position deemed most ergonomic to the user. In embodiments, the mount may include a pair of opposed grips which are engageable with the rail system or with the firearm itself. In other embodiments, the mount could be provided as an integrated component of the firearm.

In embodiments, the handle may be adjacent to the mount and the handle defines a handle axis. The handle may include a gripping surface which can be grasped, for example, by the user's forward hand. The gripping surface provides a hand hold allowing the firearm to be rapidly and easily positioned at an optimal hold point for accurate aiming of the firearm. The gripping surface of the handle may include a frictional gripping surface and the frictional gripping surface may include finger grips to aid gripping of the handle with the user's hand. The gripping surface may be of a tactile polymeric material, such as an overmolded grip.

In the embodiments, a joint engages the handle to the mount. The joint and the mount may be configured for handle movement relative to the mount to a plurality of different axial orientations in plural planes with the axes of all axial orientations intersecting one another.

A ball-and-socket joint is a type of joint which enables such engagement of the handle and the mount. The joint may include a socket and a ball in the socket. In one embodiment, the ball may support the handle. In such an embodiment, the socket may be supported by the mount and the ball may both support the handle and move relative to the socket. The socket may be within the mount.

In yet another embodiment, the socket may support the handle. In such an alternative embodiment, the ball may be supported by the mount and the socket may both support the handle and move relative to the ball.

In such ball-and-socket joint embodiments, the handle may be supported with the handle axis extending out from the ball and the handle may be capable of swiveling motion relative to the mount to the different axial orientations. Each axial orientation has the same center of rotation within the ball.

In embodiments, a movement restrictor acts on the joint to hold the handle in a selected axial orientation. Operation of the movement restrictor enables the handle to be rapidly and easily held at the selected axial orientation. And, further operation of the movement restrictor enables the handle to be rapidly and easily swivelled or otherwise moved to a new and different axial orientation. Movement restrictor embodiments are robust and apply a force which is more than sufficient to hold the handle at the desired axial position irrespective of the demanding conditions under which the firearm is used.

In certain embodiments, the movement restrictor includes a novel adaptation of the ball of the ball-and-socket joint. Such a ball embodiment may include an outwardly-spreadable segment in the ball and, in other embodiments, may include a plurality of outwardly-spreadable segments in the ball. A spreader spreads the segment or segments outward to hold the ball against the socket with the handle at the selected axial orientation. The segments may extend longitudinally away from a pole of the ball and each segment may be separated from an adjacent segment by a longitudinal groove entirely through the ball. This arrangement enables the segment or segments to spread outward enabling the circumference of the ball to be expanded. Such expansion holds the ball firmly against the socket essentially locking the handle in the desired axial orientation.

The ball may include further components enabling the outward spreading of the segment or segments and operation of the movement restrictor. In an embodiment, the ball may define a receiver opening entirely through the ball and which may be coaxial with the handle axis. The receiver opening may have a first end, which may be conical, with a decreasing cross sectional area toward the pole of the ball. The spreader may be within the receiver opening and may have an outer surface with a decreasing cross sectional area, also toward the pole, which contacts the conical first end of the receiver opening. A force applied by movement of the spreader outer surface toward the pole and against the first end of the receiver opening spreads the segments outward. The spreader may be on a pin which is coaxial with the handle axis and which includes a threaded first end extending through the receiver opening and past the pole. The handle may include a threaded female opening which meshes with the threaded first end of the pin. In such embodiment, twisting of the handle applies a force through the threads which causes the spreader to move toward the pole to spread the segments outward. Twisting of the handle in an opposite direction releases the force and enables the segments to move inward allowing the handle to be repositioned.

In other embodiments, the movement restrictor may comprise the socket and a force generator which apply a force against the ball to hold the handle in the desired axial orientation. In such embodiments, the movement restrictor includes the mount, the ball and the force generator. The socket may be within the mount. The mount may have plural mount portions which define the socket therebetween. The ball may be sized to be larger than the socket. The force generator moves the plural mount portions together to hold the socket against the ball with the handle at the selected axial orientation. An example of a force generator may include threaded pins which connect the mount portions and pull such mount portions together to clamp the ball firmly within the socket.

Other aspects and embodiments of the multi-axis firearm foregrips are described and illustrated herein.

BRIEF DESCRIPTION OF THE DRAWINGS

Exemplary multi-axis firearm foregrips may be understood by reference to the following description taken in conjunction with the accompanying drawings, in which like reference numerals identify like elements throughout the different views. The drawings are not necessarily to scale, emphasis instead being placed upon illustrating the principles of the invention. The drawings depict only embodiments of the invention and are not therefore to be considered as limiting the scope of the invention. In the accompanying drawings.

DETAILED DESCRIPTION

First Embodiment

Figure 1:
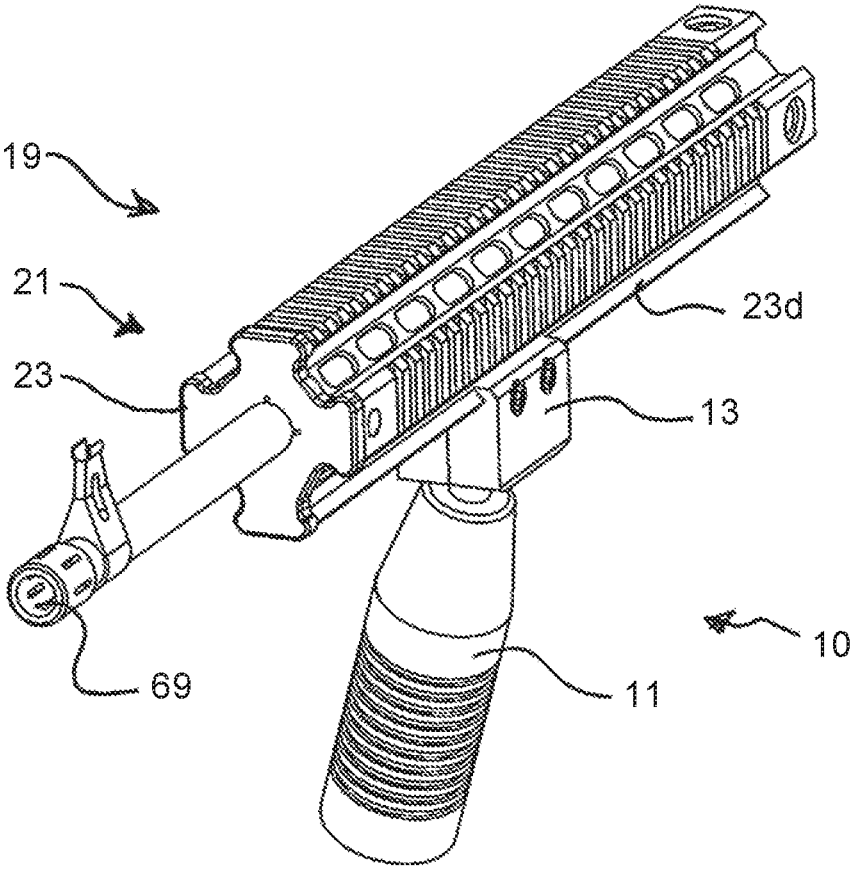
FIG. 1 is a perspective view of a multi-axis firearm foregrip embodiment coupled to a firearm fore-end by means of a rail system.
Figure 2:
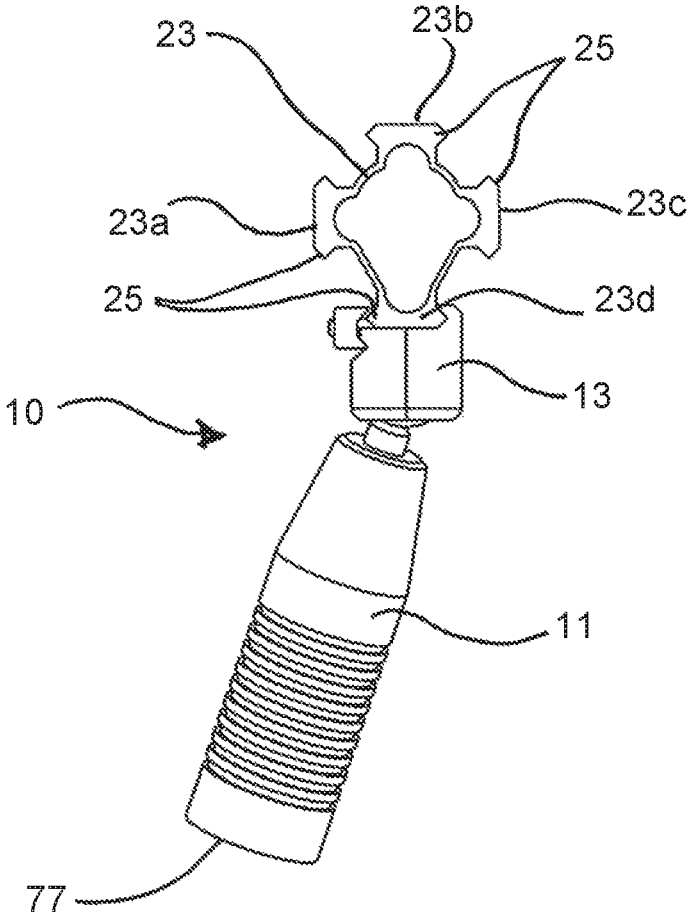
FIG. 2 is a front end elevation view of the multi-axis firearm foregrip embodiment and rail system of FIG. 1.

Referring first to FIGS. 1-18, there is shown a first embodiment of a multi-axis firearm foregrip 10. In the embodiment, foregrip 10 comprises a handle 11, a mount 13, a joint 15 and a movement restrictor 17. Handle 11 can be adjusted among a plurality of different axial orientations relative to mount 13 and then set at the axial orientation deemed most appropriate by the user. Foregrip 10 provides a type of handgrip enabling the user to manipulate firearm 19 in an improved manner. Foregrip 10 enables firearm 19 to be custom fitted to the user in an optimally ergonomic position. Foregrip 10 further enables firearm 19 to remain properly fitted to the user while firearm 19 is utilized across a range of different situational uses.

FIG. 1 illustrates a foregrip 10 implemented in connection with a firearm 19 of a semi-automatic type. It is to be understood that firearm 19 is merely an example and that foregrip 10 may be used in connection with any type of firearm for which a foregrip 10 would be deemed advantageous. Examples include, without limitation, AR-15 and M-4 firearm systems.

Referring to FIGS. 1-4, foregrip 10 may be engaged to firearm 19 fore-end 21 by means of a rail system 23. A rail system 23 may, for example, be a component secured to firearm 19 or may be an integral component of the firearm 19. In FIGS. 1-4, rail system 23 is illustrated as a "quad rail" which includes four Picatinny rails 23*a*, 23*b*, 23*c*, 23*d* spaced at 90 degree intervals around rail system 23. Each Picatinny rail 23*a*-23*d* provides an attachment point for foregrip 10 as well as accessories such as a flashlight, a laser, and/or a camera. As is known, a Picatinny rail 23*a*-23*d* consists of a series of raised ridges 25 (FIG. 2) with a T-shaped cross-section interspersed with flat "spacing slots." Accessories, such as a flashlight, laser or camera, may be mounted on the Picatinny rail 23*a*-23*d* either by sliding the accessory fore or aft on the Picatinny rail 23*a*-23*d* from one end or the other, or by mounting the accessory by means of a Weaver mount clamped to the Picatinny rail 23*a*-23*d* with bolts, thumbscrews or levers. Accessories can also be attached to a Picatinny rail 23*a*-23*d* by attachment of the accessory onto the spacing slots between the raised ridges 25 or by other means.

While rail system 23 is illustrated as a quad rail, it is to be understood that other types of systems can be implemented as an accessory attachment point. For example, rail system 23 could comprise a single Picatinny rail at a location similar to bottom Picatinny rail 23*d*.

In the example of FIGS. 1-12, mount 13 is engageable to firearm 19, for example, through attachment to rail system 23. Referring to the exploded views of FIGS. 7-8, an example of a mount 13 may include a first mount portion 27 and a second mount portion 29, each including a respective inner surface 31, 33. In the example, first and second portions 27, 29 of mount 13 are held together with inner surfaces 31, 33 in abutment by means of pins 35, 37. Each pin 35, 37 is inserted through a respective opening 39, 41 in second portion 29 of mount 13 and includes threads 43 which mesh with corresponding female threads 44 within first mount portion 27, as represented by female threads 44 in FIG. 8. Tightening of pins 33, 35 causes first and second portions 27, 29 of mount 13 to be clamped tightly together for the purpose described herein.

Figure 11:
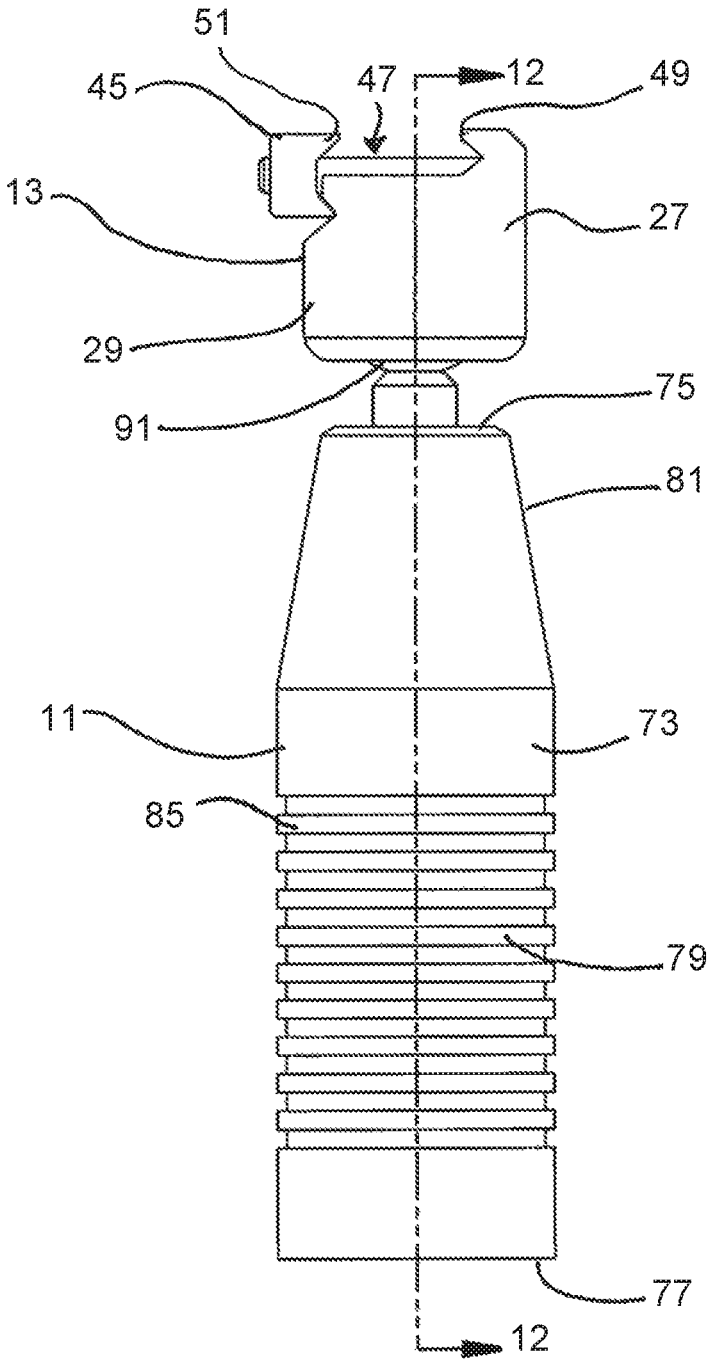
FIG. 11 is an end elevation view of the multi-axis firearm foregrip embodiment of FIG. 1.
Figure 12:
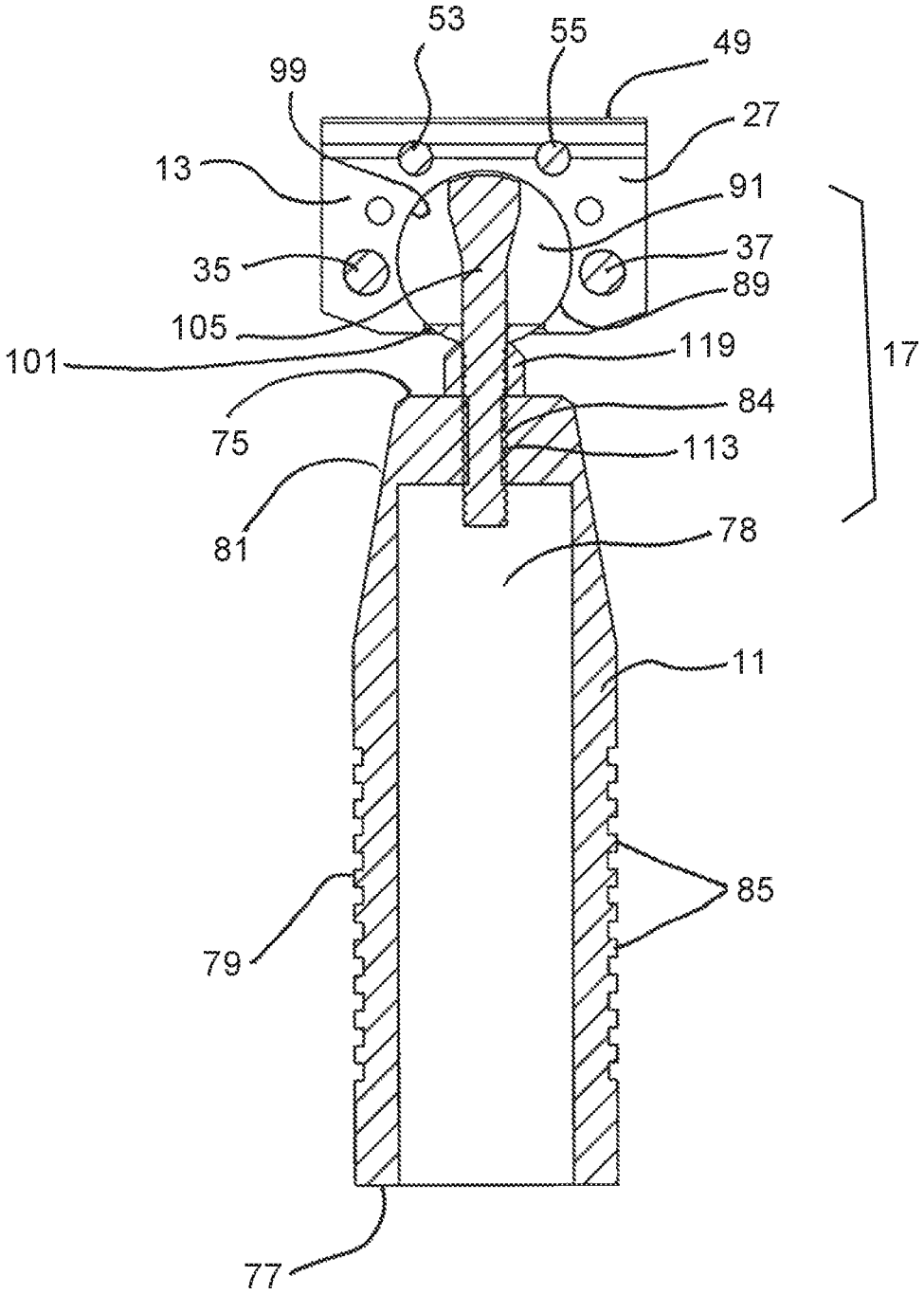
FIG. 12 is a section view of the multi-axis firearm foregrip embodiment of FIG. 1 taken along section 12-12 of FIG. 11.
Figure 15:
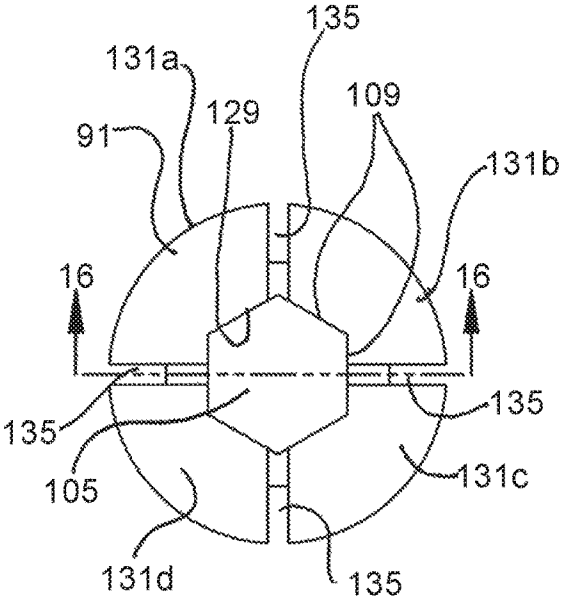
FIG. 15 is a plan view of the exemplary ball of FIGS. 13-14 further including a pin.
Figure 14:
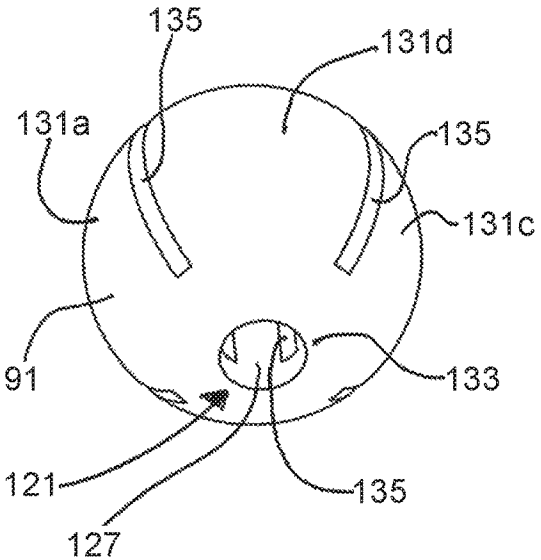
FIGS. 13-14 are perspective views of an exemplary ball for use with the multi-axis foregrip of FIG. 1.
Figure 13:
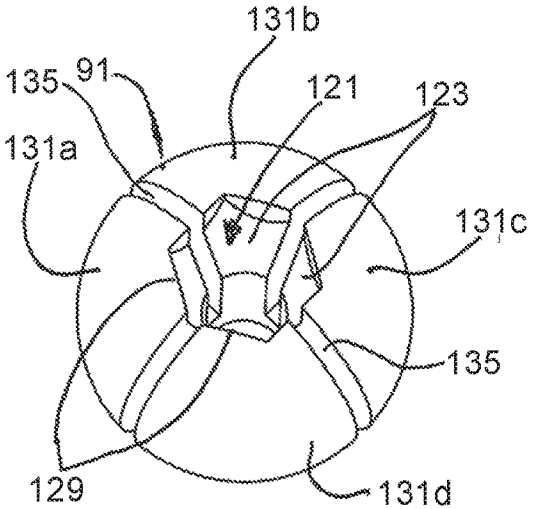

Mount 13 may be secured to any of the Picatinny rails 23*a*-23*d* but is preferably secured to bottom Picatinny rail 23*d*. In the example, mechanical attachment of mount 13 to the preferred Picatinny rail 23*d* may be accomplished by a clamping force applied by first and second mount portions 27, 29 and clamp 45 against raised ridges 25 of Picatinny rail 23*d*. More specifically, first mount portion 27 together with second mount portion 29 and clamp 45 collectively provide a female cavity 47 with inwardly-facing opposed grips 49, 51 which conform with raised ridge 25 of Picatinny rail 23*d* (and rails 23*a*-23*c*) as illustrated in the example of FIG. 11.

Figure 3:
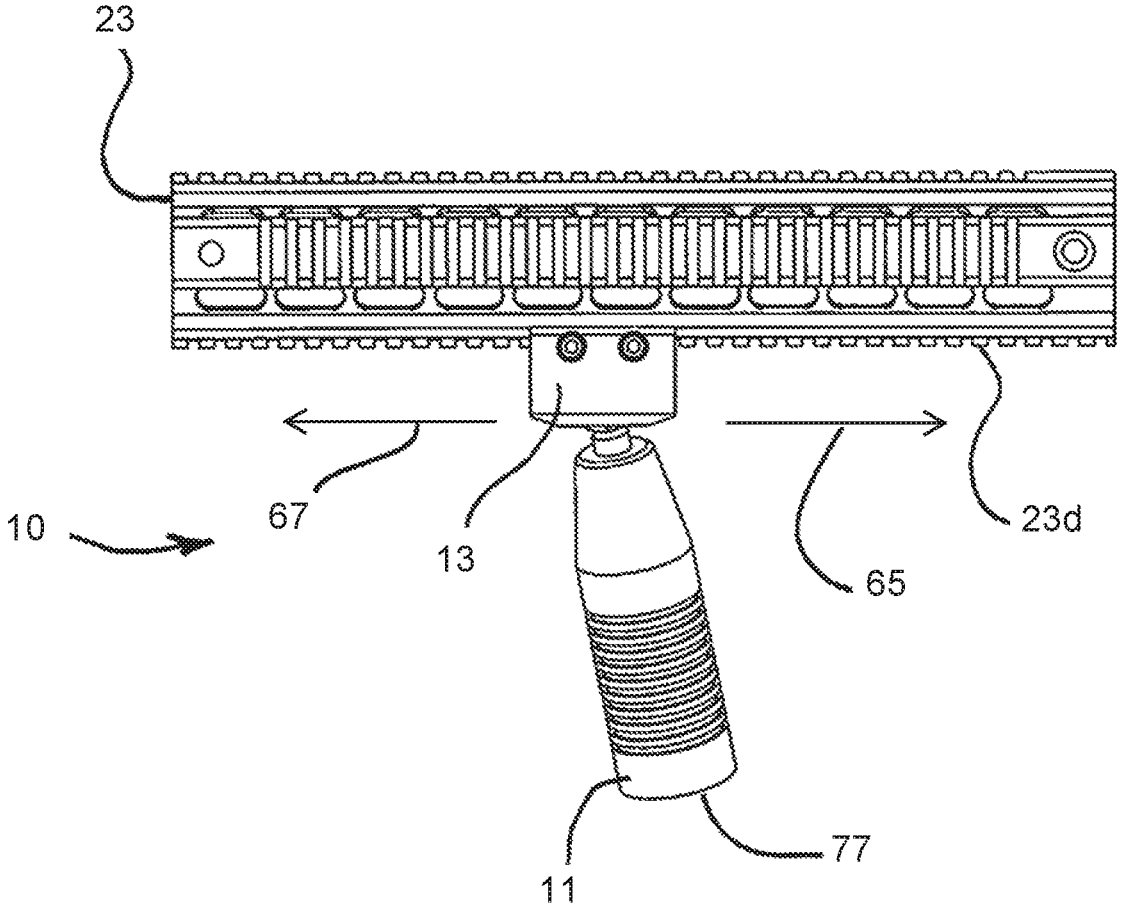
FIG. 3 is a side elevation view of the multi-axis firearm foregrip embodiment and rail system of FIG. 1.
Figure 4:
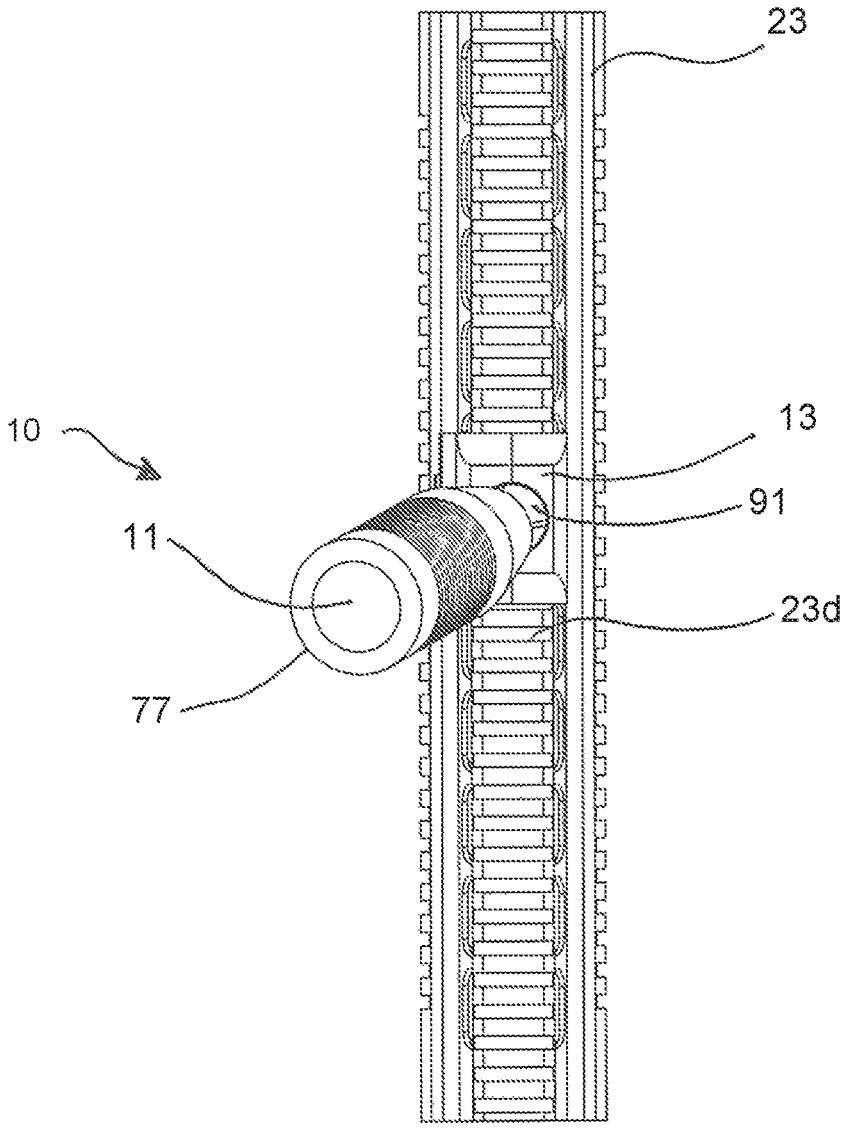
FIG. 4 is a bottom side view of the multi-axis firearm foregrip embodiment and rail system of FIG. 1.

Clamp 45 is drawn tightly against second mount portion 29 and toward first mount portion 27 by pins 53, 55. Each pin 53, 55 is inserted through a respective opening 57, 59 in first portion 27 of mount 13 and includes threads 61, 63 which mesh with corresponding female threads (not shown) within clamp 45. Tightening of pins 53, 55 causes first and second mount portions 27, 29 and clamp 45 to be clamped tightly against, and in abutment with, raised portion 25 of Picatinny rail 23*d* to clamp mount 13 in a fixed position on Picatinny rail 23*d* to secure foregrip 10 to firearm 19. Before tightening of pins 53, 55 and as illustrated in FIG. 3, mount 13 may slide along Picatinny rail 23*d* rearward in the direction of arrow 65 or forward in the direction of arrow 67 toward or away from muzzle 69 of firearm 19 (FIG. 1) and to a position anywhere along Picatinny rail 23*d* which is most ergonomic for the user.

Mount 13 illustrated in FIGS. 1-12 may be made of any suitable material or materials. Representative materials include metal, carbon fiber and composites. Components of mount 13 may be made by any suitable process known to persons of skill in the art.

While mount 13 is illustrated as being attached to rail system 23, it is to be understood that mount 13 could be attached to firearm 19 by means other than a rail system 23. For example, mount 13 may be adapted to be secured directly to fore-end 21 by means of an appropriate fastener system and without a rail system 23. By way of further example, mount 13 may be a built-in or integral component of firearm 19 itself. In such an embodiment, the firearm itself could be the mount with joint 15 within the firearm. A separate mount of type illustrated by reference number 13 would not be needed. A mount merely refers to a part that engages joint 15 to firearm 19.

In the example of FIGS. 1-12, handle 11 is provided for gripping by the user's forward hand. Exemplary handle 11 provides a type of pistol grip. Handle 11 has a handle axis 71. Handle axis 71 projects outwardly from mount 13 in the example. Handle 11 includes a body 73 with first and second ends 75, 77 and a hollow interior space 78 (FIG. 12) to minimize weight. Body 73 may have a gripping portion 79 of a generally cylindrical shape and a conical tapered portion 81 toward first end 75. In the example, female opening 83 with threads 84 is provided in first end 75 of body 73 for purposes of securing handle 11 with respect to mount 13 as described herein.

As illustrated in FIGS. 1-12, body 73 may include features purposed to improve gripping of handle 11 by the user's hand. For example, body 73 may include annular ribs 85 transverse to handle axis 71 to provide a frictional gripping surface for a secure handhold of handle 11. Body 73 could also be knurled or otherwise textured to facilitate gripping of handle 11.

Figure 10:
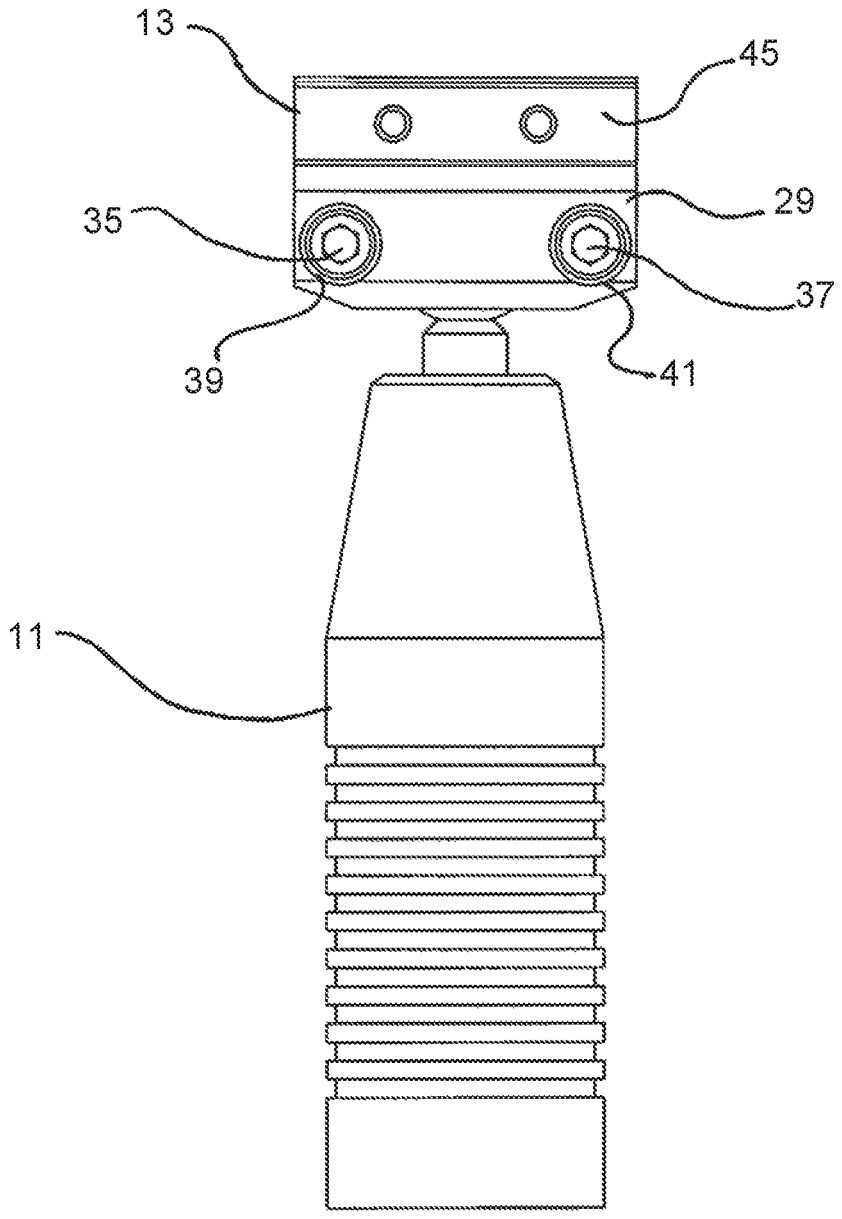
FIG. 10 is a second side elevation view of the multi-axis firearm foregrip embodiment of FIG. 1.
Figure 10A:
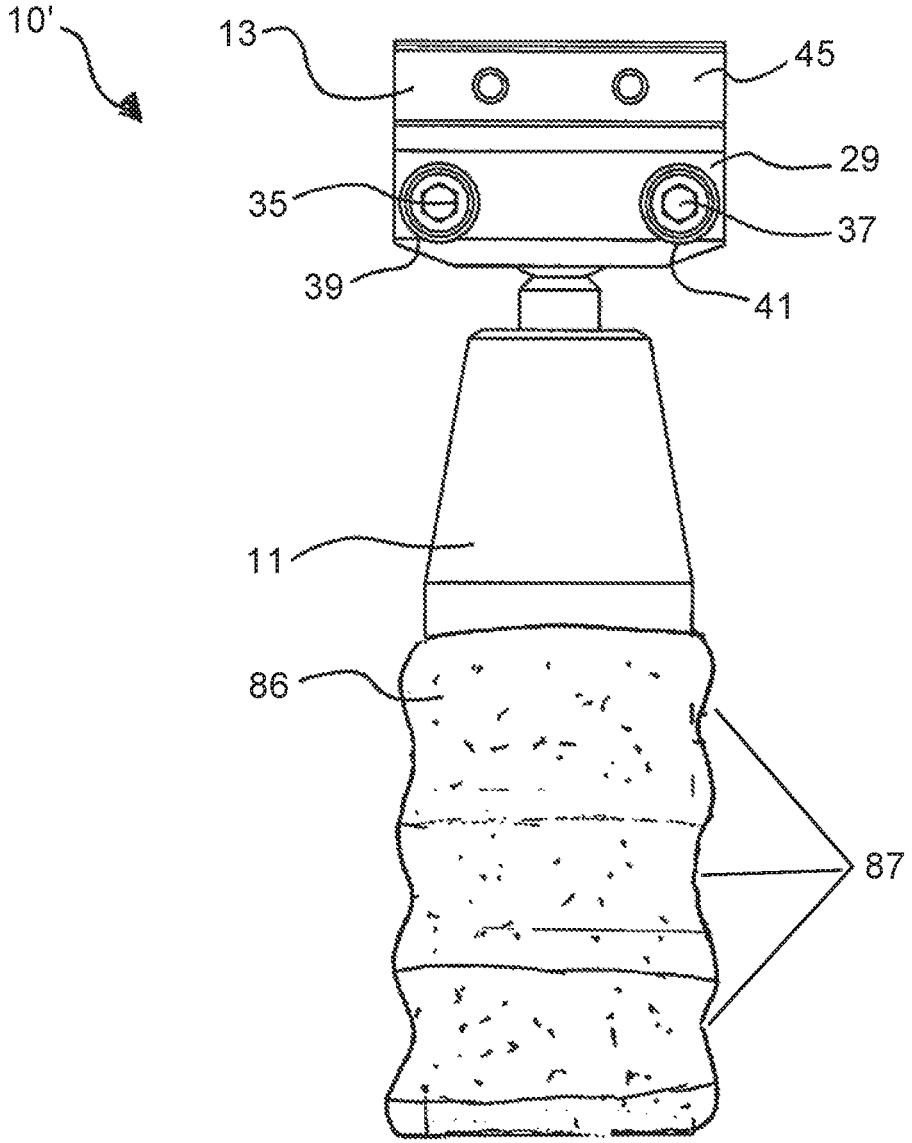
FIG. 10A is a side elevation view of a further multi-axis firearm foregrip embodiment including a further gripping surface.

In a further foregrip 10' embodiment illustrated in FIG. 10A, handle 11 may include a tactile overmolded polymeric grip 86 over body 73. Overmolded grip 86 may include finger grips 87 formed therein to assist the user with gripping of handle 11. Overmolded grip 86 is a further type of frictional gripping surface which provides for a secure handhold of handle 11.

Handle 11 may be made of any suitable material or materials. Representative materials include metal, carbon fiber and composites. Handle 11 may be sized to ergonomically fit a user's hand. For example, handle 11 body 73 could be provided in different sizes, each with a circumference appropriate for a small hand, or a medium-size hand, or a large hand.

Referring now to the example of FIGS. 5-8 and 12-18, a joint 15 may engage handle 11 to mount 13. In the example, joint 15 provides for movement of handle 11 relative to mount 13 and firearm 19. In the example of FIGS. 5-8 and 12-18, joint 15 is a ball-and-socket-type joint including a socket 89 and a ball 91. Implementation of a ball-and-socket-type joint 15 enables handle 11 to move in a swiveling motion relative to mount 13 and firearm 19. Handle 11 is able to move relative to mount 13 to a plurality of different axial orientations in plural planes with the axes of all axial orientations intersecting one another at a center of rotation indicated by reference number 94.

Referring further to FIGS. 5-8 and 12-18, socket 89 may be a component of mount 13 and ball 91 swivels in socket 89. In the embodiment, socket 89 is within and supported by mount 13 and ball 91 moves with respect to, that is relative to, socket 89.

Other arrangements are envisioned. For example, in the embodiment illustrated in FIGS. 22-24, ball 491 is within socket 489. But, ball 491 may be in a fixed position while socket 489 supports handle 411 and swivels with respect to ball 491 as described below.

Socket 89 may be a spherical cavity 93 formed by a hemispherical first socket portion 95 recessed in first mount portion 27 and a hemispherical second socket portion 97 recessed in second mount portion 29. Spherical cavity 93 is formed when first and second mount portions 27, 29 are clamped together by pins 35, 37 with inner surfaces 31, 33 held in abutment as previously described. Spherical cavity 93 includes a surface 99 which faces ball 91 and against which ball 91 rides when ball 91 is received in socket 89. Spherical cavity 93 further includes an edge 101 defining opening 102 through which ball 91 protrudes.

In the example of FIGS. 1-18, ball 91 may be in the form of a sphere with an outer surface 103 which rides against surface 99 of spherical cavity 93 when ball 91 is received in spherical cavity 93. According to the example, ball 91 supports handle 11 coaxial with handle axis 71 with handle 11 extending out from ball 91. Socket 89 and ball 91 are sized so that when first and second portions 27, 29 of mount 13 are held together, ball 91 has freedom to swivel within socket 89. Socket 89 and ball 91 may be sized so that there is some frictional resistance to movement of ball 91 within socket 89 when movement restrictor 17 is not fully operative. When movement restrictor 17 is fully operative, ball 91 is held in a fixed position relative to socket 89.

Referring further to FIGS. 5-8 and 12-18, ball 91 includes components and features which enable ball 91 to both support handle 11 and to serve as a component of movement restrictor 17. Handle 11 is supported by pin 105 which, in turn, is supported by ball 91 as described herein. Pin 105 is provided to both support handle 11 and serve as a component of movement restrictor 17 in the example. Pin 105 may have a first end 107 with outwardly-facing flats 109, a second end 111 with threads 113 and a cylindrical body 115 therebetween. Tapering away from first end 107 toward second end 111 is a spreader 117 which, in this example, may be in the form of a conical tapered wedge which has a decreasing cross sectional area (e.g., a decreasing diameter) toward second end 111. Thus, threads 113 are associated with spreader 117 in the sense that movement of threads 113 moves spreader 117 in this embodiment. Pin 105 is coaxial with handle axis 71 in the embodiment. Threads 113 of pin 105 mesh with female threads 84 in opening 83 provided in first end 75 of handle 11 body 73. Bushing 119 may be fitted around pin 105 to space handle 11 from ball 91.

Referring to FIGS. 13-18, ball 91 includes a receiver opening 121 in which pin 105 is received in ball 91. Receiver 121 may be a bore-like female opening entirely through a diameter of ball 91. Receiver 121 may be coaxial with handle axis 71 and pin 105. Pin 105 may be received in receiver 121 as illustrated in FIGS. 15-18 before ball 91 is received in spherical cavity 93 of socket 89. In the example, receiver 121 has a first end 123 which may be conical, a cylindrical central portion 125 and a second end forming outlet opening 127 in ball 91 outer surface 103 through which pin 105 first end 107 and threads 113 extend. In the example, conical first end 123 of receiver 121 has a decreasing cross sectional area (e.g., a decreasing diameter) toward outlet opening 127 and pole 133. The conical tapered wedge element of spreader 117 abuts conical first end 123 of receiver 121 when pin 105 is within receiver 121. Conical first end 123 further includes inwardly-facing flats 129 which contact flats 109 of pin 105 to limit rotation of pin 105 when pin 105 is within receiver 121 for the reasons described herein.

Figure 18:
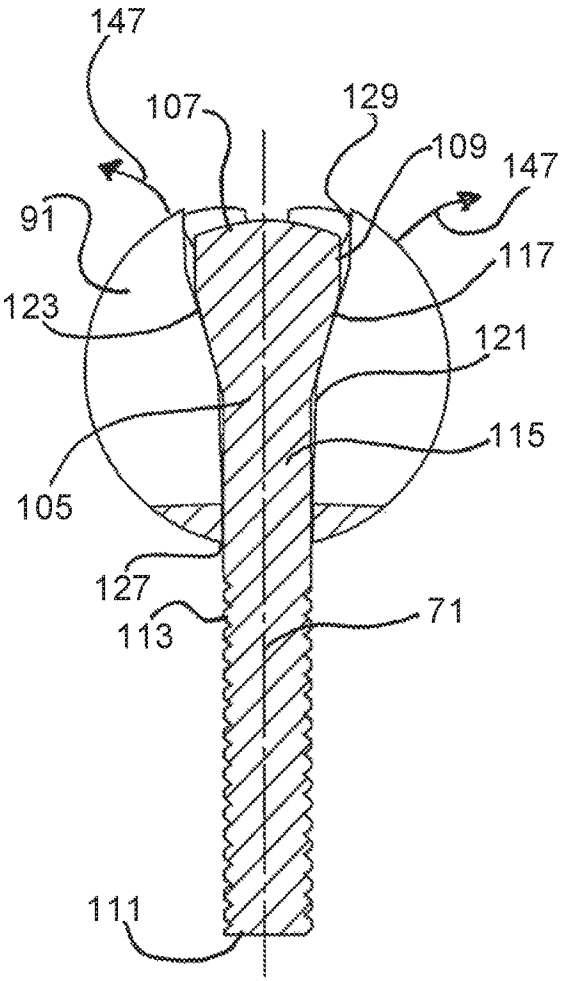
FIG. 18 is a section view of the exemplary ball and pin taken along section 16-16 of FIG. 15 illustrating a second and outwardly-spread position of the ball.
Figure 17:
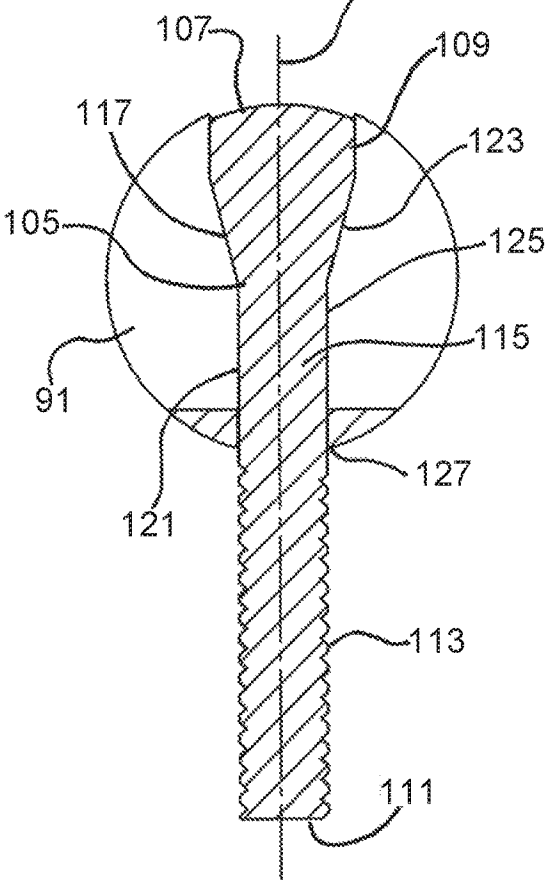
FIGS. 16-17 are section views of the exemplary ball and pin taken along section 16-16 of FIG. 15 illustrating a first and relaxed position of the ball.
Figure 16:
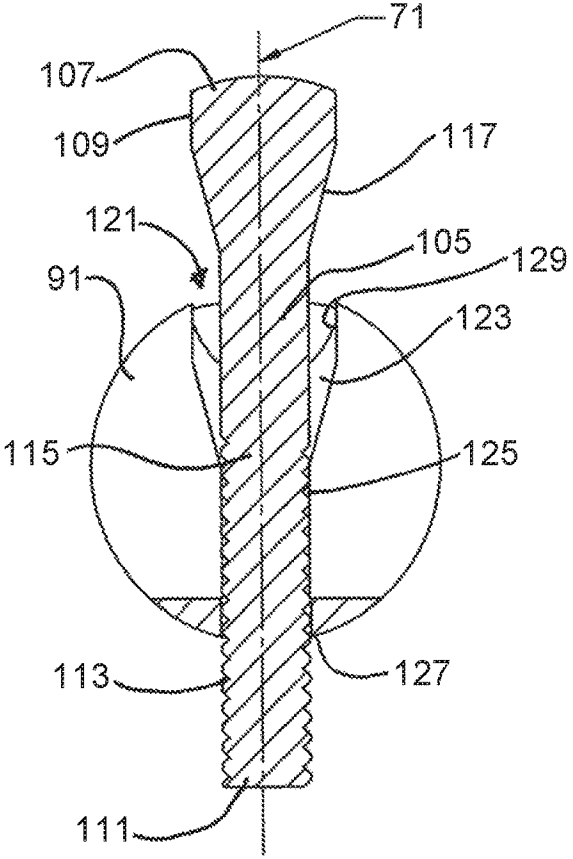

Referring again to FIGS. 13-18, ball 91 may be coaxial with receiver 121 and with handle axis 71 and may be segmented. Ball 91 may be divided into four segments 131*a*, 131*b*, 131*c*, 131*d* as illustrated in FIGS. 13-18. The segments 131*a*-131*d* as illustrated radiate longitudinally away from pole 133 of ball 91 and each segment 131*a*-131*d* is separated from the adjacent segment 131*a*-131*d* by a longitudinal groove 135 also radiating away from pole 133 of ball 91. In the example, each longitudinal groove 135 is entirely through ball 91 to allow segments 131*a*-131*d* to be spread outwardly to hold ball 91 against socket 89. As described herein, an urging force can be applied to segments 131*a*-131*d* to cause one or more segment 131*a*-131*d* to move or spread outward from a first position to a second position as illustrated in FIGS. 16-18. And, each segment 131*a*-131*d* may have a memory which causes each segment 131*a*-131*d* to move back to, or toward, the first position when the urging force is removed or lessened.

While four segments 131*a*-131*d* are illustrated in the example, it is to be understood that four segments 131*a*-131*d* are not required and other structure may be provided. For example, other ball 91 embodiments may include one segment which moves (e.g., just segment 131*a*) or any number of segments. Ball 91 may be made of any suitable material or materials. Representative materials for ball 91 include metal, carbon fiber and composites.

FIGS. 1-6 illustrate a representative range of motion of joint 15 and handle 11 relative to mount 13 and firearm 19 as provided by foregrip 10. Handle 11 supported by ball 91 has freedom to swivel to a plurality of axial orientations all having the same center of rotation 94 within ball 91. In the example, handle axis 71 extends through center of rotation 94 in all positions of handle 11. When movement restrictor 17 is not fully operative, freedom of ball 91 to swivel and move within socket 89 is limited only by contact between pin 105 and edge 101 defining socket opening 102.

Figure 5:
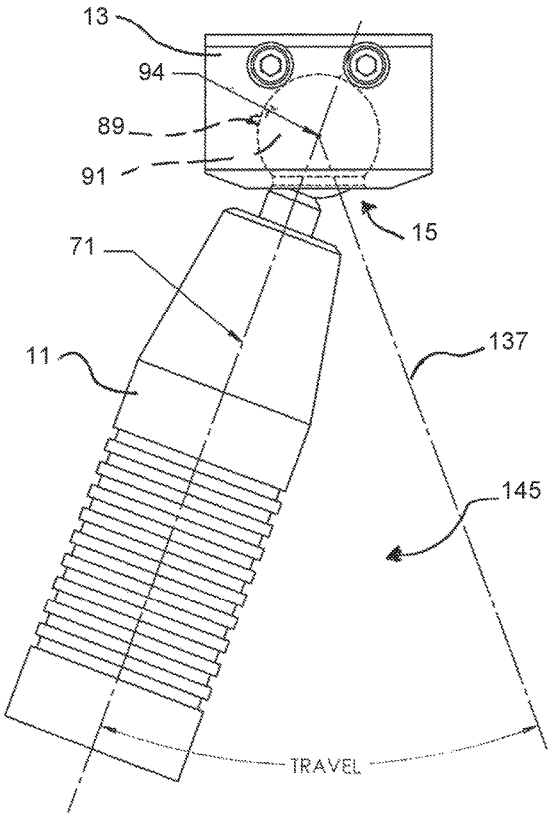
FIG. 5 is a side elevation view of the multi-axis firearm foregrip embodiment of FIG. 1 with certain hidden portions illustrated in broken line and illustrating a range of handle movement to a plurality of different axial orientations.
Figure 6:
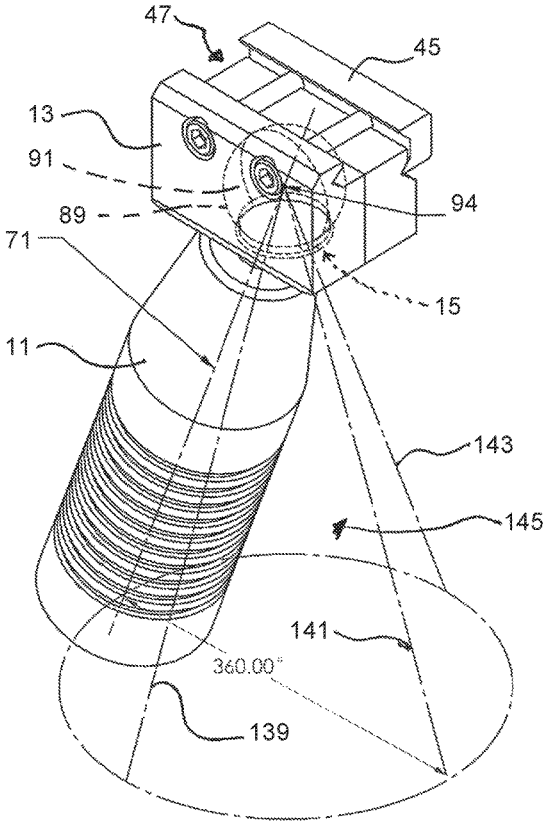
FIG. 6 is a perspective view of the multi-axis firearm foregrip embodiment of FIG. 1 with certain hidden portions illustrated in broken line and illustrating a further range of handle movement to a plurality of different axial orientations.
Figure 7:
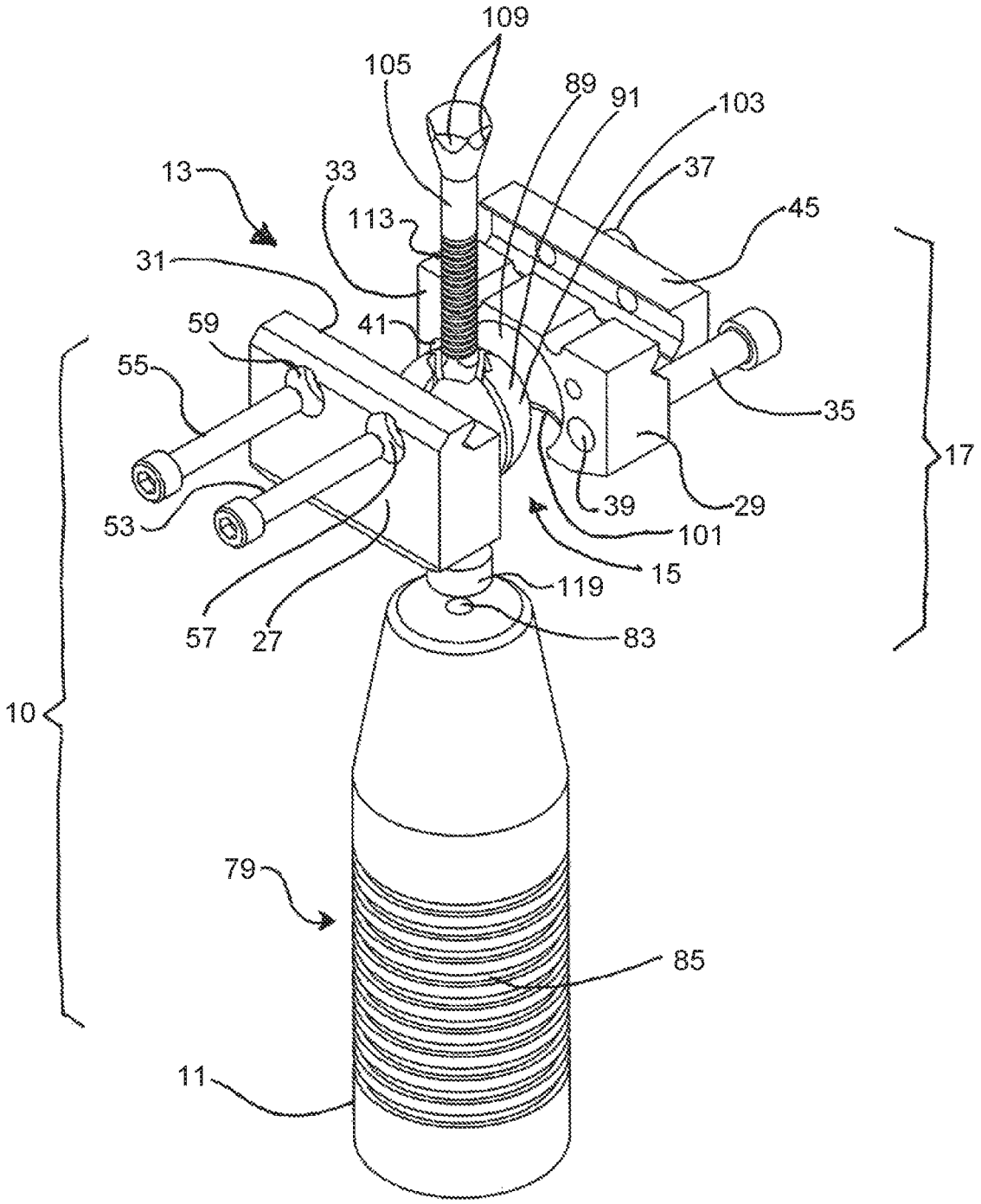
FIG. 7 is an exploded perspective view of the multi-axis firearm foregrip embodiment of FIG. 1.
Figure 8:
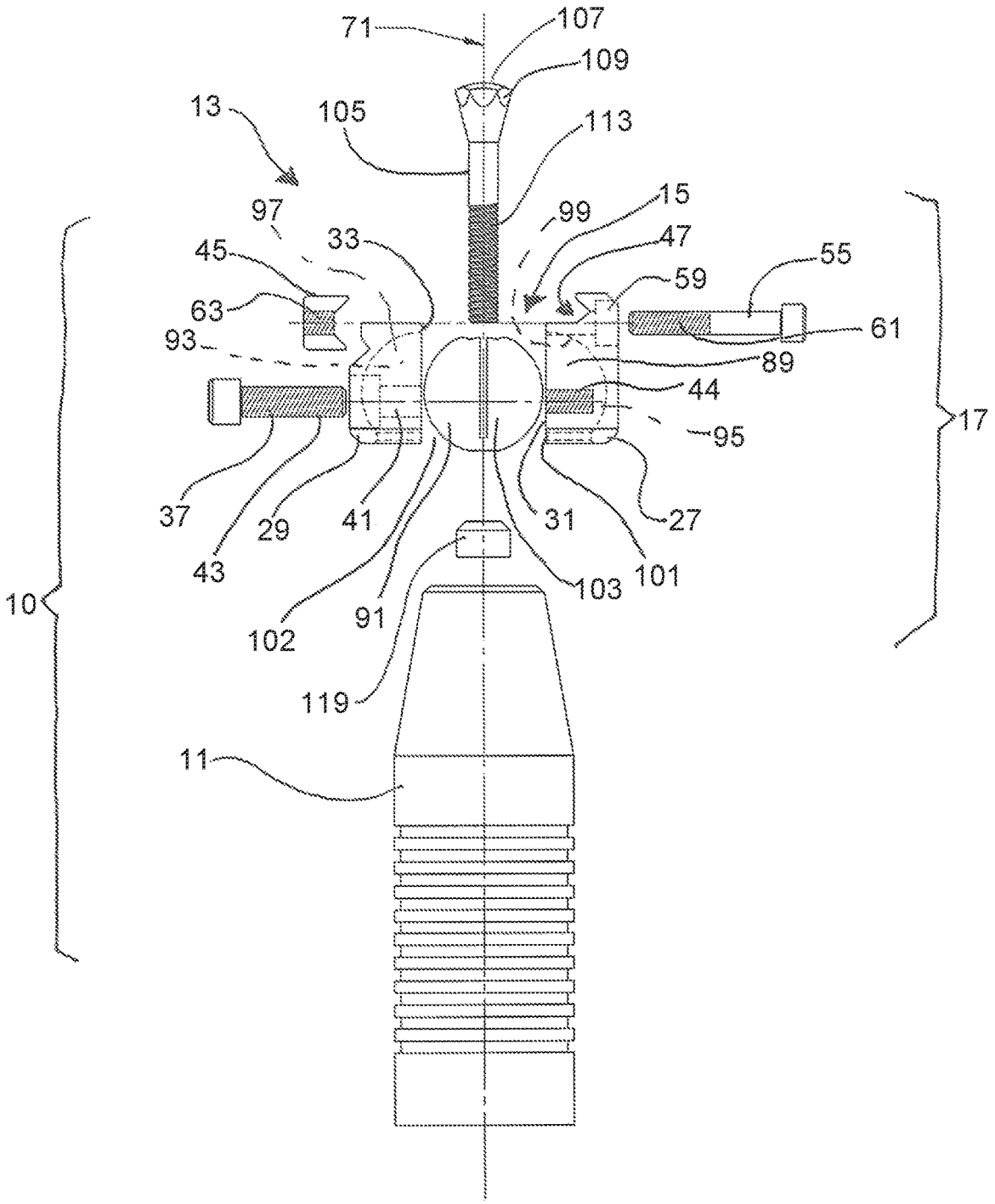
FIG. 8 is an exploded end elevation view of the multi-axis firearm foregrip embodiment of FIG. 1 with certain hidden portions illustrated in broken line.
Figure 9:
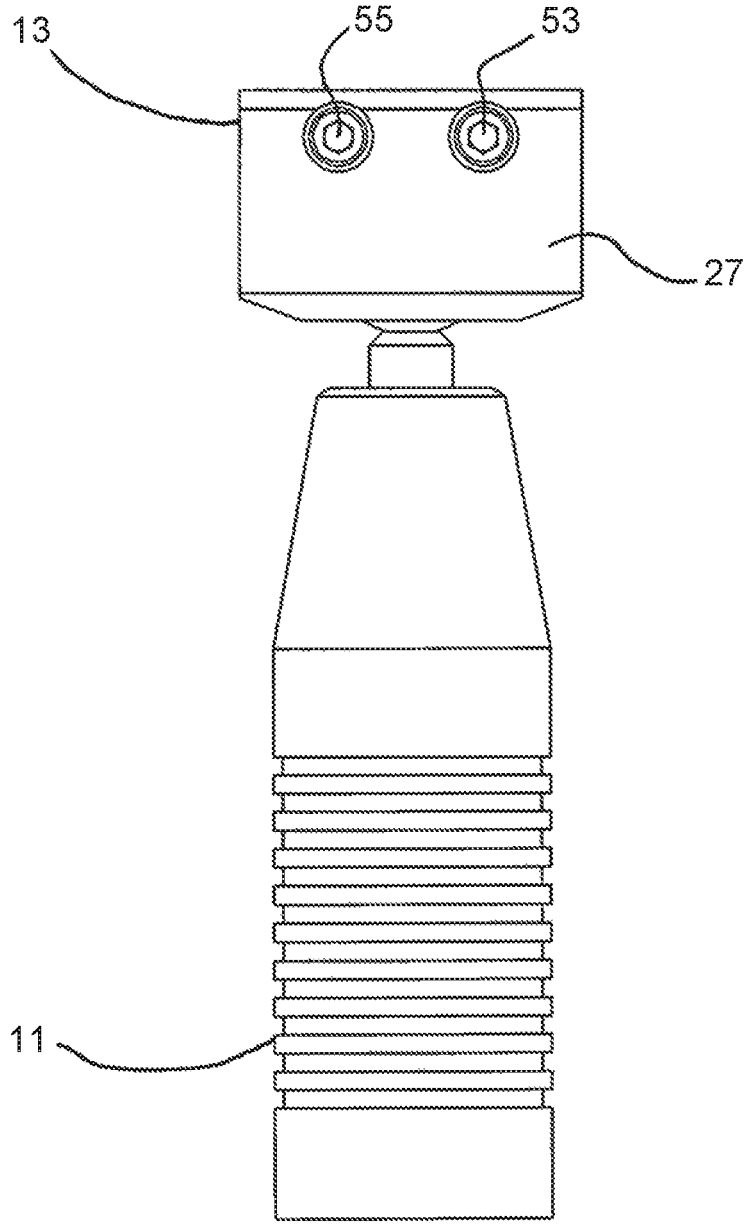
FIG. 9 is a first side elevation view of the multi-axis firearm foregrip embodiment of FIG. 1.

As illustrated in FIGS. 5 and 6, broken lines representing handle axis 71 and other potential positions 137, 139, 141, 143 of handle 11 represent different axial orientations in which handle 11 may be positioned. Any two of the axial orientations represented by broken lines 71, 137, 139, 141, 143 lie in a plane. An infinite number of planes exist in the example. The axes of all of the axial orientations, including those represented by broken lines 71, 137, 139, 141, 143, intersect one another at the center of rotation indicated by reference number 94 in the example. For a ball-and-socket-type joint 15, all axes have the same center of rotation 94 within ball 91 where the axes 71, 137, 139, 141, 143 intersect. Accordingly, and as illustrated in FIGS. 5-6, handle 11 has freedom to swivel and move in a conical region 145 of space permitting both pitch and roll movement of handle 11 relative to mount 13 and firearm 19.

This swiveling movement of ball 91 within socket 89 allows handle 11 to be angled back-and-forth, side-to-side and combinations thereof. FIGS. 1-4 illustrate just one example in which handle 11 second end 77 is both angled toward muzzle 69 (pitch angle) and to a side of mount 13 (roll angle). The position of handle 11 in FIGS. 1-4 can be compared with the angled position of handle 11 in FIGS. 5-6 (pitch and roll angles) and the further position of handle 11 (FIGS. 9-12) in which handle second end 77 is directly beneath mount 13 (neutral pitch and roll angles). FIGS. 1-4, 5-6 and 9-12 all illustrate the capability of setting the handle 11 with handle axis 71 at any one position of the many potential axial orientations which is most ergonomic for that user.

Referring next to FIGS. 7-8 and 12-18 there is shown one embodiment of a movement restrictor 17 capable of holding ball 91 within socket 89 with handle 11 and handle axis 71 at the axial position and orientation most ergonomic to the user and the situational use of firearm 19. In the embodiment, major components of movement restrictor 17 include handle 11, joint 15 including socket 89 and ball 91, and pin 105 with spreader 117.

In the example, movement restrictor 17 applies a force which urges segments 131*a*-131*d* outward in the direction of arrows 147 (FIG. 18) so that ball 91 is held against socket 89. The force is applied through pin 105 and pin threads 113 meshed with female threads 84 of handle 11 causing spreader 117 to be pulled against conical first end 123 of receiver 121 to spread the segments 131*a*-131*d* outward.

Referring to FIGS. 17-18, ball 91 is initially in a first, or relaxed position illustrated in FIG. 17. In the first position (FIG. 17), segments 131*a*-131*d* exert little or no force against socket 89. Ball 91 can swivel within socket 89 and handle 11 may be moved to any of the axial orientations illustrated, for example, in FIGS. 5-6.

Clockwise rotation of handle 11 tightens ball 91 against bushing 119. The handle 11 rotation exerts a force which moves handle 11 and the conical tapered surface of spreader 117 each toward the other. Ball 91 is drawn against bushing 119 during the handle 11 tightening. Handle 11 can be rotated relative to pin 105 because interference contact between flats 109 of pin 105 and flats 129 in receiver 121 first end 123 limits rotation of pin 105. Frictional contact between ball 91 and socket 89 limits rotational movement of ball 91 within socket 89.

Referring to FIG. 18, further clockwise tightening rotation of handle 11 causes spreader 117 to move toward and into contact with conical first end 123 of receiver 121. As handle 11 and conical wedge element 117 move toward the other, the increasing cross sectional area of spreader 117 exerts a force against conical first end 123 of receiver 121 causing segments 131*a*-131*d* to move outward in the direction of arrows 147. Outward movement of segments 131*a*-131*d* can be appreciated by a comparison of the ball 91 circumference as illustrated in FIG. 17 with the relatively larger ball 91 circumference as illustrated in FIG. 18. In effect, ball 91 expands outwardly to hold ball 91 tightly against socket 89 to hold handle 11 with handle axis 71 at the selected axial orientation which is one of many potential positions of handle 11 relative to mount 13 and firearm 19. The outward position of segments 131*a*-13*d* in FIG. 18 represents a second, or outward, position of ball 91.

In certain embodiments, socket surface 99 and outer surface 103 of ball 91 may be textured, knurled, dimpled or otherwise coarsened. The coarsened surfaces 99, 103 may be useful to provide friction which may improve holding of ball 91 against socket 89 to prevent movement of handle 11 relative to mount 13 and firearm 19.

Reverse operation of movement restrictor 17 by counter-clockwise rotation of handle 11 exerts a force which moves handle 11 and spreader 117 each away from the other loosening ball 91 and bushing 119. Continued interference contact between flats 109 of pin 105 and flats 129 of receiver 121 conical first end 123 continues to limit rotation of pin 105 so that handle 11 and spreader 117 can move apart. Movement of handle 11 and spreader 117 apart releases the force applied by spreader 117 against conical first end 123 of receiver 121. This, in turn, permits the memory of segments 131*a*-131*d* to move segments 131*a*-131*d* inward back to the first position (FIGS. 16-17) so that ball 91 can swivel within socket 89 and handle 11 can again be moved relative to mount 13 and firearm 19 to the desired axial orientation of handle 11 and handle axis 71.

Second Embodiment

Figure 20:
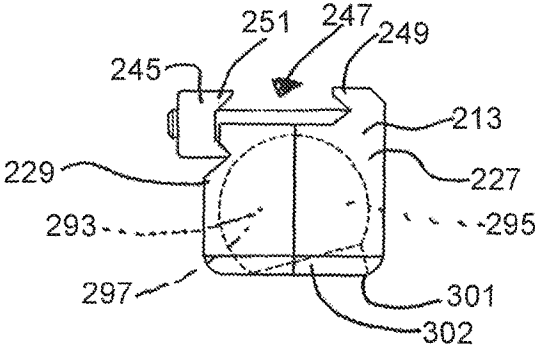
FIGS. 20-21 are respectively end elevation and bottom plan views of a mount for use with the multi-axis foregrip of FIG. 19 with certain hidden portions illustrated in broken line.
Figure 21:
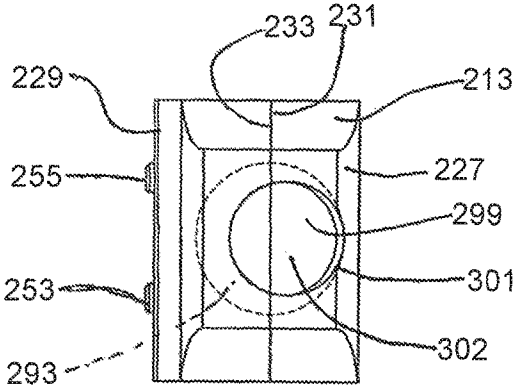
Figure 19:
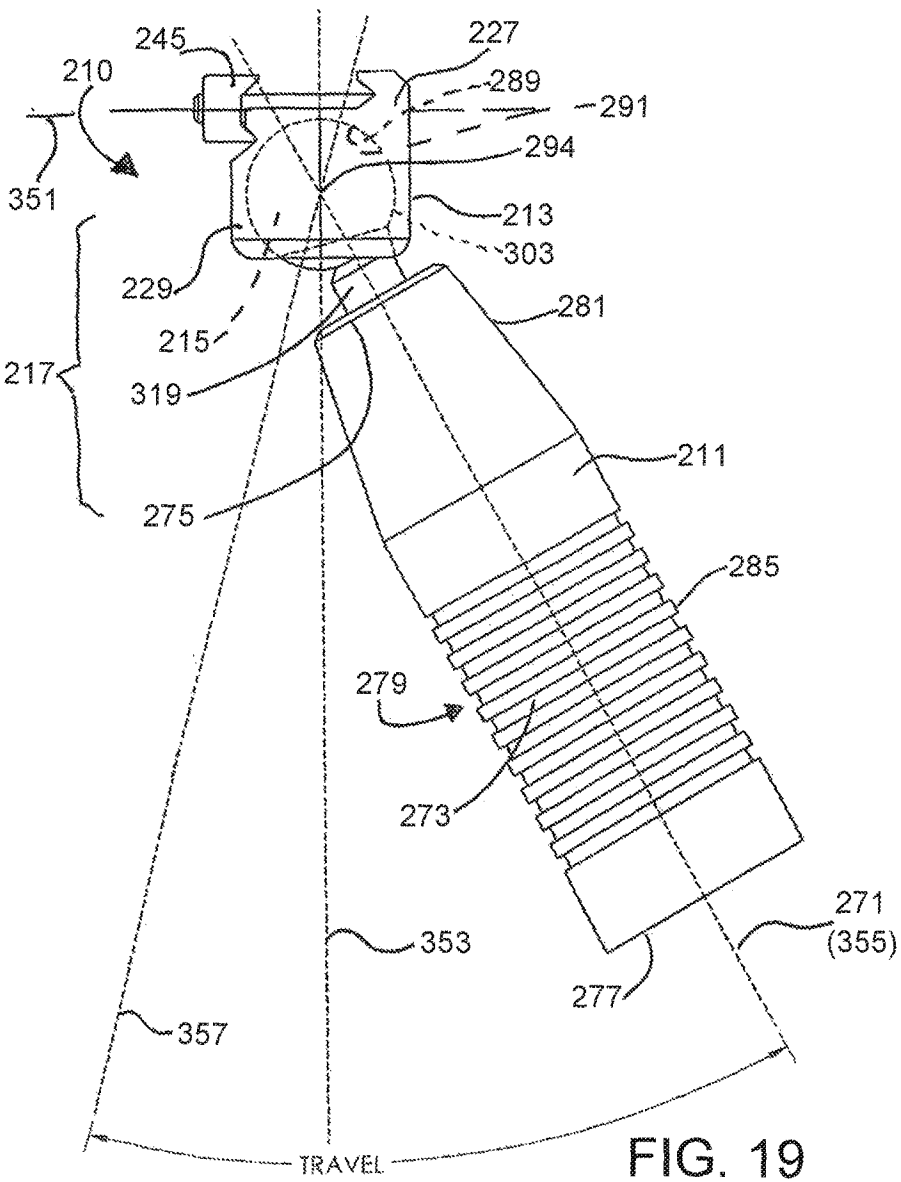
FIG. 19 is an end elevation view of a second embodiment of a multi-axis firearm foregrip with certain hidden portions illustrated in broken line.

Referring next to FIGS. 19-21, there is shown a second embodiment of a multi-axis firearm foregrip 210. Foregrip 210 is identical to the example of foregrip 10 except that multi-axis firearm foregrip 210 is configured to enable handle 211 to be at axial orientations further laterally outward from a firearm (e.g., firearm 19) than possible with the example of foregrip 10 described previously. Such a range of laterally-outward axial orientations may be desirable and ergonomic for a user who wishes to hold firearm fore-end (e.g., firearm 19 fore-end 21) toward a side of such firearm with the user's forward arm and elbow in a more upright position. The sole difference between the examples of foregrip 210 and foregrip 10 is the structure of mount 213 and the resultant joint 215 which enables the laterally outward positioning of handle 211 as described herein. Accordingly, the description of foregrip 10, other than mount 13, is incorporated by reference in its entirety with respect to foregrip 210 with reference numbers of like parts being increased by 200.

Referring then to the example of FIGS. 19-21, foregrip 210 comprises a handle 211, a mount 213, a joint 215, including socket 289 and ball 291, and a movement restrictor 217. Foregrip 210 may be engaged to a firearm fore-end (e.g., firearm 19 fore-end 21) by means of a rail system 23, such as a quad rail with Picatinny rails 23*a*, 23*b*, 23*c*, 23*d* illustrated in FIGS. 1-4, in the same manner and for the same purposes as described with respect to with foregrip 10 thereby allowing foregrip 210 to be located on rail system 23 at a position deemed most ergonomic for the firearm user.

In the embodiment of FIGS. 19-21, mount 213 is identical to mount 13 except that socket 289 and socket opening 302 are positioned in mount 213 to enable handle 211 to be held at the laterally outward axial orientations illustrated in FIG. 19. Mount 213 includes first and second mount portions 227, 229, each including a respective inner surface 231, 233 held in abutment by pins (not shown) identical to pins 33, 35 of foregrip 10 in the same manner and for the same purpose as described in connection with foregrip 10.

Mount 213 may be attached to a Picatinny rail (e.g., rail 23*d* FIGS. 1-4) by a clamping force applied by first and second mount portions 227, 229 and clamp 245 drawn tightly against second mount portion 229 and toward first mount portion 227 by pins 253, 255 in the same manner and for the same purpose as pins 53, 55 described in connection with foregrip 10. Female cavity 247 with inwardly-facing opposed grips 249, 251 conform with raised ridge 25 of Picatinny rail 23*d* (and rails 23*a*-23*c*) as illustrated in the example of FIGS. 19-20. Mount 213 may slide along Picatinny rail 23*d* in a forward or rearward direction (e.g., directions of arrows 65, 67 FIG. 3) before tightening of pins 253, 255.

Referring further to FIGS. 19-21 and the example of foregrip 210 illustrated therein, mount 213 provides for a portion of joint 215 which engages handle 211 to mount 213. Like joint 15 of foregrip 10, joint 215 provides for movement of handle 211 relative to mount 213 and firearm (e.g., firearm 19). In the example of FIGS. 19-21, joint 215 is a ball-and-socket-type joint including socket 289 and ball 291. Ball-and-socket-type joint 215 enables handle 211 to move in a swiveling motion relative to mount 213 and firearm such as firearm 19 of FIG. 1. Handle 211 is able to move relative to mount 213 to a plurality of different axial orientations in plural planes with the axes of all axial orientations intersecting one another at a center of rotation indicated by reference number 294 in FIG. 19.

Referring once again to FIGS. 19-21, mount 213 includes socket 289 and ball 291 swivels in socket 289. In the embodiment, socket 289 is within and supported by mount 213 and ball 291 moves with respect to, that is relative to, socket 289. Socket 289 of FIGS. 19-21 is illustrated as a spherical cavity 293 formed by a hemispherical first socket portion 295 recessed in first mount portion 227 and a hemispherical second socket portion 297 recessed in second mount portion 229. Spherical cavity 293 is formed when first and second mount portions 227, 229 are clamped together by pins such as pins 35, 37 with inner surfaces 231, 233 held in abutment as previously described. Spherical cavity 293 includes a surface 299 which faces ball 291 and against which ball 291 rides when ball 291 is received in socket 289. Spherical cavity 293 further includes an edge 301 defining opening 302 through which ball 291 protrudes and which allows for the laterally outward positioning of handle 211 as described below.

In the example of FIGS. 19-21, ball 291 may be identical to ball 91 for the same purposes as ball 91 and the description of ball 91 is incorporated by reference in its entirety with respect to ball 291. Such a ball 291 may include a receiver, segments, pole and longitudinal grooves (not shown) respectively identical to receiver 121, segments 131*a*-131*d*, pole 133 and longitudinal grooves 135 as described and illustrated previously. A pin (not shown) identical to pin 105, including spreader 117, may extend through a receiver opening (e.g., receiver opening 121), bushing 319 and into handle 211 to link ball 291 to handle 211 and the description of pin 105 and spreader 117 are incorporated by reference in their entirety with respect to foregrip 210.

In the example of FIGS. 19-21, handle 211 is identical to handle 11. Handle 211 includes handle 271 axis, handle body 273, first and second ends 275, 277, gripping portion 279, conical tapered portion 281 toward first end 275 and annular ribs 285. Handle 211 further includes a female threaded opening with threads (not shown) identical to female opening and threads 83, 84 described in connection with handle 11 into which a pin first end (not shown) identical to pin 105 threaded first end 107 is meshed thereby linking ball 291 and handle 211. In other embodiments, a tactile surface such as overmolded polymeric grip 86 with finger grips 87 (FIG. 10A) may also be provided over body 273.

In the example of FIGS. 19-21, mount 213 differs from mount 13 in that socket 289, edge 301 and socket opening 302 defined by mount 213 are slightly offset with respect to mount 213 as compared with mount 13. This configuration and arrangement of mount 213 and joint 215 enables handle 211 to be held by movement restrictor 217 at axial orientations further laterally outward from the firearm (e.g., firearm 19) than possible with foregrip 10.

Such offset may be understood with respect to certain reference points illustrated in FIG. 19. In the example, mount 213 of foregrip 210 defines a reference plane 351 which is coplanar or parallel with a Picatinny rail (e.g., rail 23*d* FIGS. 1-4). Mount 213 further defines a reference axis 353 perpendicular to plane 351. Mount 213 differs from mount 13 in that socket 289 and edge 301 defining socket opening 302 are provided in mount 213 at an angle defining a central axis of motion 355 which is offset from reference axis 351. In the example, central axis of motion 355 is offset from reference axis 353 by approximately 6 degrees although no particular amount of offset is required. This arrangement provides handle 211 with an increased range of motion toward a side of the firearm (e.g., firearm 19) and toward the user's side. The range of handle 211 motion is limited by contact between bushing 319 and edge 301 or handle 211 and edge 301.

As illustrated in FIG. 19, broken lines 353, 355, 357 represent different axial orientations in which handle 211 may be positioned. Any two of the axial orientations represented by broken lines 353, 355, 357 lie in a plane. An infinite number of planes exist in the example. The axes of all of the axial orientations, including those represented by broken lines 353, 355, 357 intersect one another at the center of rotation indicated by reference number 294 in the example. For a ball-and-socket-type joint 215, all axes have the same center of rotation 294 within ball 291. Handle 211 has freedom to swivel and move in a conical region of space (e.g., similar to, but offset from, conical region 145 of FIG. 6) permitting both pitch and roll movement of handle 211 relative to mount 213 and the firearm (e.g., firearm 19).

This swiveling movement of ball 291 within socket 289 allows handle 211 to be angled back-and-forth, side-to-side and combinations thereof in the same manner as foregrip 10 illustrated in FIGS. 1-6 and 9-12 with a single center 294 of ball 291 rotation. But, foregrip 210 provides an increased range of handle 211 motion toward a side of the firearm (e.g., firearm 19) and toward the user's side as illustrated, for example, in FIG. 19. Handle 211 may be held by movement restrictor 217 with handle axis 271 at any one position of the many potential axial orientations which is most ergonomic for that user.

Movement restrictor 217 may be identical to movement restrictor 17 in structure and operation and the description of movement restrictor 17 is incorporated by reference in its entirety with respect to movement restrictor 217. Movement restrictor 217 may include major components comprising handle 211, joint 215 including socket 289 and ball 291 and a pin with spreader (not shown) identical to pin 105 with spreader 117 previously described and illustrated.

Movement restrictor 217 may operate in a manner identical manner to movement restrictor 17. Clockwise rotation of handle 11 tightens ball 291 against bushing 319. Handle 211 rotation exerts a force which moves handle 211 and the conical tapered surface of spreader (e.g., spreader 117) each toward the other. Ball 191 is drawn against bushing 319 during the handle 211 tightening.

Movement restrictor 217 applies a force which urges ball 291 segments, which may be identical to segments 131*a*-131*d*, outward in the direction of arrows 147 (FIGS. 16-18) so that ball 291 is held tightly against socket 289. The force is applied in the same manner as movement restrictor 17, namely, through a pin (e.g., pin 105) meshed with female threads (e.g., threads 84) of handle 211 and with spreader (e.g., spreader 117) pulled against conical first end of the receiver opening (e.g., conical first end 123, receiver opening 121). Tightening or, alternatively, loosening rotation of handle 211 relative to pin (e.g., pin 105) provides or relieves the force. Once the force is applied, handle 211 is held in the selected one of the axial orientations. Such force is more than adequate to hold handle 211 in position even as the firearm (e.g., firearm 19) is used rigorously. The force may be rapidly relieved merely by loosening rotation of handle 211 in an opposite direction thereby enabling handle 211 to be set with handle axis 271 at a different position and axial orientation relative to mount 213 and the firearm (e.g., firearm 19).

In the example of FIGS. 19-21, foregrip 213 is ambidextrous. Mount 213 can be removed from a Picatinny rail (e.g., rail 23*d* FIGS. 1-4), rotated 180 degrees, and reattached to such Picatinny rail. Ambidextrous foregrip 213 enables handle 211 to extend to the opposite side of the firearm (e.g., firearm 19) allowing foregrip 213 to accommodate right- and left-handed users.

Third Embodiment

Figure 22:
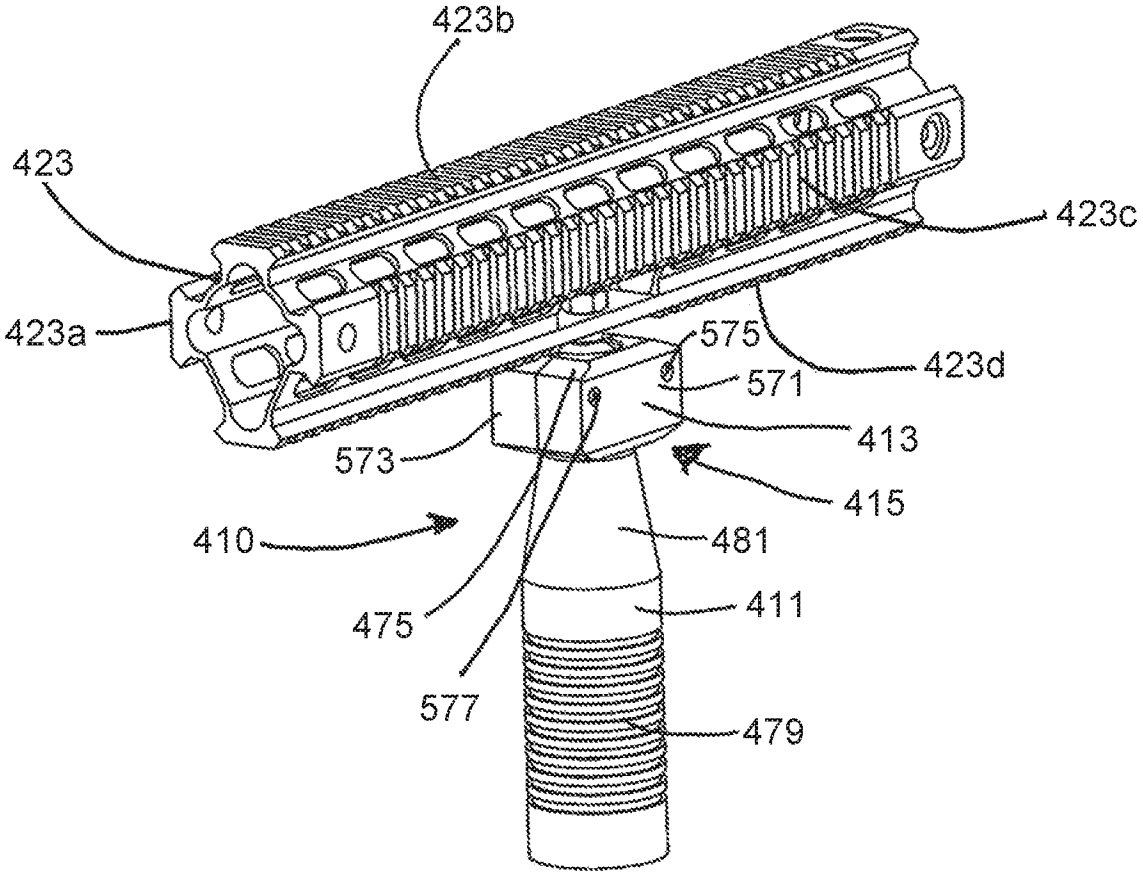
FIG. 22 is a perspective view of a third embodiment of a multi-axis firearm foregrip embodiment coupled to a rail system.
Figure 23:
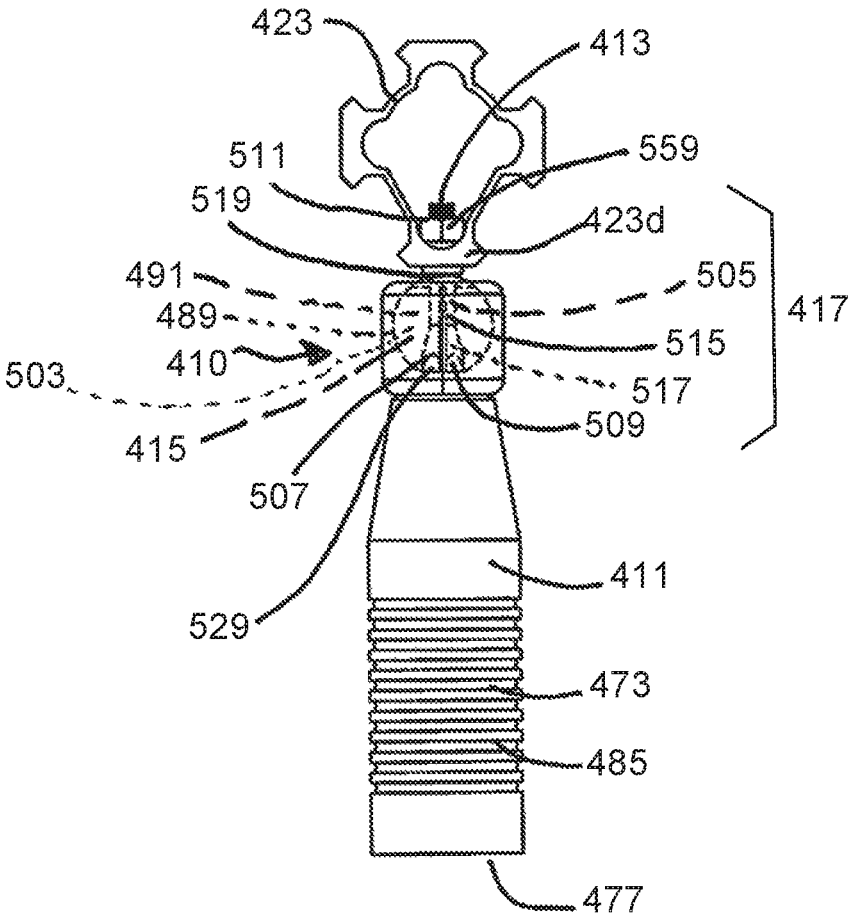
FIG. 23 is a front end elevation view of the multi-axis firearm foregrip embodiment and rail system of FIG. 22 with certain hidden portions illustrated in broken line.
Figure 24:
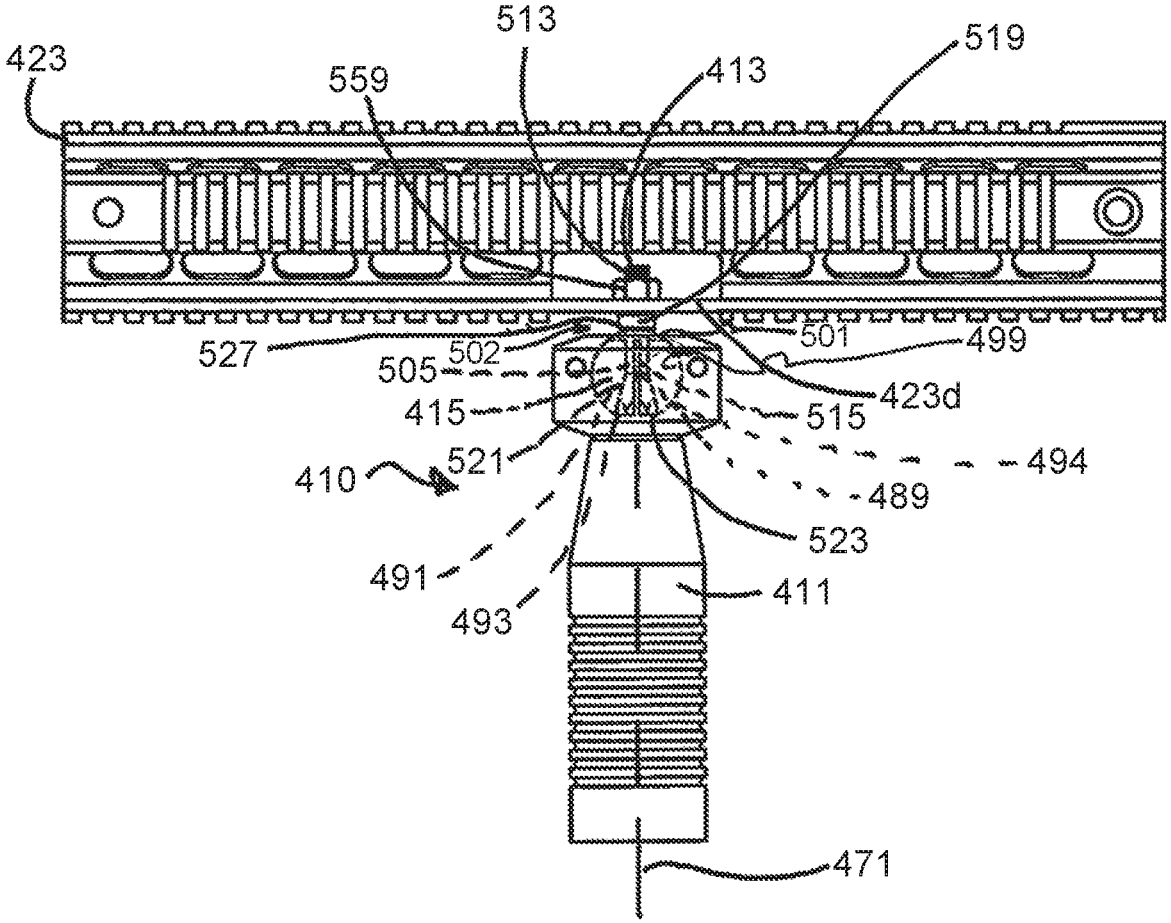
FIG. 24 is a side elevation view of the multi-axis firearm foregrip embodiment and rail system of FIG. 22 with certain hidden portions illustrated in broken line.

Referring next to FIGS. 22-24, there is shown a third embodiment of a multi-axis firearm foregrip 410. According to the third embodiment, ball 491 is supported by mount 413 and socket 489 both supports handle 411 and moves relative to ball 491. Also in the third embodiment, pin 505 performs a dual role serving both as mount 413 and as a component of movement restrictor 417 illustrating that variation of foregrip components is contemplated. In the example, foregrip 410 may share certain components with foregrip 10. For convenience and brevity, such shared components are indicated with like reference numbers increased by 400.

In the example of FIGS. 22-24, foregrip 410 comprises a handle 411, a mount 413, a joint 415, including socket 489 and ball 491, and a movement restrictor 417. In FIGS. 22-24, foregrip 410 may be engaged to a firearm fore-end (e.g., firearm 19, fore-end 21) by means of a rail system 423, such as a quad rail with Picatinny rails 423*a*, 423*b*, 423*c*, 423*d*. In the example, mount 413 extends entirely through rail system 423 Picatinny rail 423*d* (preferably inserted entirely through an unshown hole in rail 423*d*) and is held in place on rail system 423 by interference of pin 505 with rail 423*d* and by bushing 519 and nut 559. Attachment points other than illustrated in FIGS. 22-24 may be provided in rail system 423 to enable foregrip 410 to be located at other positions forward or rearward along rail system 423 (e.g., directions of arrows 65, 67 FIG. 3) deemed most ergonomic for the firearm user.

Referring again to FIGS. 22-24, mount 413 may include a pin 505 identical to pin 105 illustrated in FIGS. 7-8, 12, and 16-18. Pin 505 comprising mount 413 may be of any suitable robust material. Pin 105 may have a first end 507 with outwardly-facing flats 509 and a second end 511 with threads 513 and a cylindrical axial body 515 therebetween. Tapering away from first end 507 toward second end 511 is a spreader 517 which may be in the form of a conical tapered wedge which has a decreasing cross-sectional area (e.g., a decreasing diameter) toward second end 511. Bushing 519 may be fitted around pin 505 to act as a spacer spacing ball 591 from rail 423*d*.

In the example of FIGS. 22-24, ball 491 may be identical to ball 91 for the same purposes as ball 91 and the description of ball 91 is incorporated by reference in its entirety with respect to ball 491. Such a ball 491 may include a receiver opening 521 identical to receiver opening 121, in which pin 505 is received in ball 491. Receiver 521 may be a bore-like female opening entirely through a diameter of ball 591. Receiver 521 may be coaxial with handle axis 471 and pin 505. Pin 505 may be received in receiver 521 as illustrated in FIGS. 22-24 before ball 491 is received in socket 489. In the example, receiver 521 has a first end 523 which may be conical, a cylindrical central portion 525 and a second end forming outlet opening in ball 491 outer surface 503 through which pin 505 first end 507 and threads 513 extend. Conical first end 523 has an decreasing cross-sectional area (e.g. a decreasing diameter) toward outlet opening 527. The conical tapered wedge element of spreader 517 abuts conical first end 523 of receiver 521 when pin 505 is within receiver 521. Conical first end 523 further includes inwardly-facing flats 529 which contact flats 509 and of pin 505 to limit rotation of pin 505 when pin 505 is within receiver 521 for the reasons described herein.

Ball 491 may also include a pole and segments and longitudinal grooves (not shown) identical to, and for the same purpose as, segments 131*a*-131*d*, pole 133 and longitudinal grooves 135 described and illustrated previously with regard to FIGS. 13-18. The descriptions of such segments 131*a*-131*d*, pole 133 and longitudinal grooves 135*a*-135*d* are incorporated by reference with respect to ball 491. Ball 491 may be of the same materials as ball 91.

Referring further to FIGS. 22-24, socket 489 may be a component of handle 411. In such embodiment, socket 489 and handle 411 swivel around ball 491, which is stationary, and socket 489 moves with respect to, or relative to, ball 491, mount 413 and firearm (e.g., firearm 19). Socket 489 may be a spherical cavity 493 formed by a hemispherical first socket portion 567 and a hemispherical second socket portion 569. Socket portions 567, 569 may be within respective socket bodies 571, 573 which attach to handle 411. Spherical cavity 493 is formed when first and second socket bodies 571, 573 are clamped together by pins 575, 577. Spherical cavity 493 includes a surface 499 which faces spherical surface 503 of ball 491 and against which socket 489 and socket portions 567, 569 ride when socket 489 is around ball 491. Spherical cavity 493 further includes an edge 501 defining opening 502 through which ball 491 protrudes.

Socket 489 and ball 491 are sized so that when socket bodies 571, 573 are held together, socket 489 has freedom to swivel around ball 491 when movement restrictor 417 is not fully operative to hold socket 489 in a fixed position relative to ball 491. Socket 489 and ball 491 may be sized so that there is frictional resistance to movement of socket 489 around ball 491 when movement restrictor 417 is not fully operative.

In the example of FIGS. 22-24, handle 411 is attached to socket bodies 571, 573 so that handle 411 moves with socket bodies 571, 573. Handle 411 includes handle 471 axis, handle body 473, first and second ends 475, 477, gripping portion 479, conical tapered portion 481 toward first end 475. Annular ribs 485 provide a frictional gripping surface. In other embodiments, a tactile surface such as overmolded polymeric grip 86 with finger grips 87 (FIG. 10A) may also be provided over body 473.

In the example, movement restrictor 417 applies a force which urges ball 491 segments (i.e., segments 131*a*-131*d*) outward (e.g., direction of arrows 147 FIG. 18) so that ball 491 is held tightly against socket 489. The force is applied through pin 505 with bushing 519 held against surface 503 of ball 491 and rail 423*d*. Tightening of nut 559 pulls pin 505 toward nut 559 so that spreader 517 is pulled against conical first end 523 of receiver 521. The force applied by contact between spreader 517 and conical first end 523 of receiver spreads segments (e.g., segments 131*a*-131*d*) outward from a first position to a second position as illustrated in FIGS. 16-18. Each segment (e.g., segments 131*a*-131*d*) may have a memory which causes each segment to move back to, or toward, the first position when the urging force is removed or lessened when nut 559 is loosened. The force applied through pin 505 is more than adequate to hold socket 489 and handle 411 in the selected position even as firearm (e.g., firearm 19) is rigorously used.

The force may be rapidly relieved merely by loosening nut 559 thereby enabling handle 411 to be set at a different axial position with handle axis 471 at a selected different axial orientation relative to mount 413, ball 491 and firearm (e.g., firearm 19).

When movement restrictor 417 is not fully operative, handle 411 mounted to socket 489 can be swivelled relative to mount 413 and ball 491 in the same manner as described in connection with foregrip 10 and as illustrated in FIGS. 5-6. The axes of all of the axial orientations intersect one another at the center of rotation indicated by reference number 494 in the example. For a ball-and-socket-type joint 415, all axes have the same center of rotation within ball 491 at their intersection which is the center of rotation 494 in this example.

Accordingly, and in the same manner as illustrated in FIGS. 5-6, handle 411 has freedom to swivel and move in a conical region of space to different axial orientations in plural planes thereby permitting both pitch and roll movement of handle 411 relative to mount 413 and firearm (e.g., firearm 19). This swiveling movement of socket 489 around ball 491 allows handle 411 to be angled back-and-forth, side-to-side and combinations thereof providing the capability of setting handle 411 with handle axis 471 at any one position of the many potential axial orientations which is most ergonomic for that user. The desired position of handle 411 can be set by full operation of movement restrictor 417.

Fourth Embodiment

Figure 26:
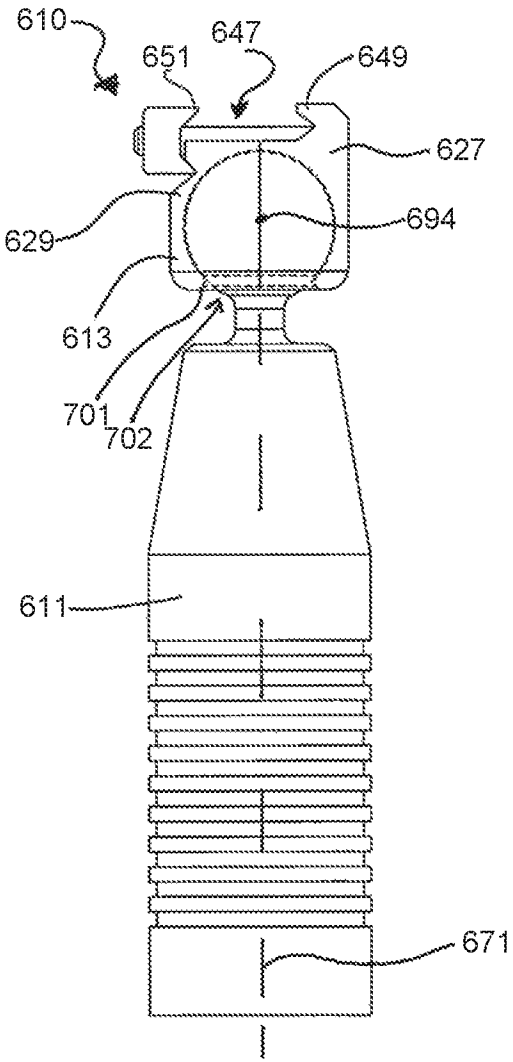
FIG. 26 is an assembled end elevation view of the embodiment of the multi-axis firearm foregrip of FIG. 25 with certain hidden portions illustrated in broken line.
Figure 25:
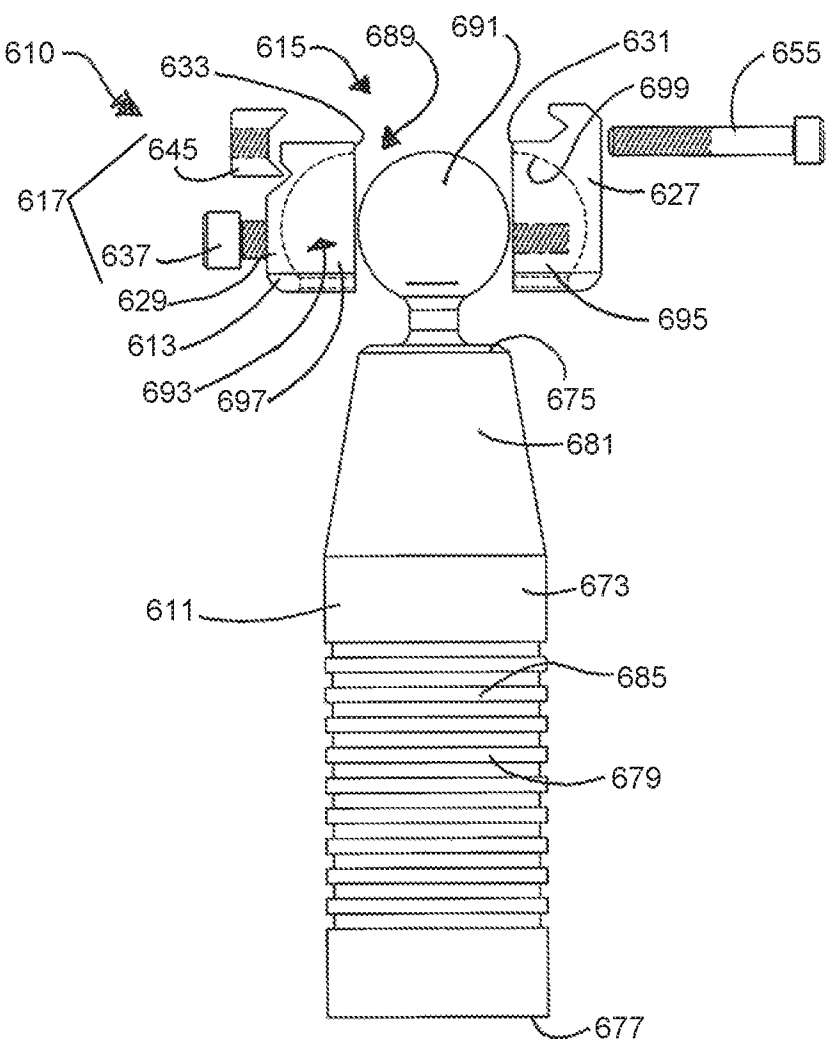
FIG. 25 is an end elevation exploded view of a fourth embodiment of a multi-axis firearm foregrip with certain hidden portions illustrated in broken line.

Referring next to FIGS. 25-26, there is shown a fourth embodiment of a multi-axis firearm foregrip 610. According to the fourth embodiment, joint 615 engages handle 611 to mount 613 and mount 613 is engageable to a firearm, such as firearm 19 of FIG. 1. Movement restrictor 617 clamps ball 691 and socket 689 together to hold handle 611 in a selected axial orientation. In the example, foregrip 610 may share certain components with foregrip 10. For convenience and brevity, such shared components are indicated with like reference numbers increased by 600.

In the example of FIGS. 25-26, foregrip 610 comprises a handle 611, a mount 613, a joint 615, including socket 689 and ball 691, and a movement restrictor 617. Foregrip 610 may be engaged to a firearm fore-end (e.g., firearm 19, fore-end 21) by means of a rail system 23, such as a quad rail with Picatinny rails 23*a*, 23*b*, 23*c*, 23*d* illustrated in FIGS. 1-4.

Referring to FIGS. 25-26, an example of a mount 613 may include a first mount portion 627 and a second mount portion 629, each including a respective inner surface 631, 633. In the example, first and second mount portions 627, 629 are held together with inner surfaces 631, 633 in abutment by means of threaded pins, one of which is shown as 637 (an identical pin is hidden behind pin 637 in FIG. 25). Such pins (e.g., pin 637) can be tightened or loosened with a conventional hex head wrench. Tightening of such pins (e.g., pin 637) causes first and second mount portions 627, 629 to be clamped tightly together for the purpose described herein.

Mount 613 may be attached to a Picatinny rail (e.g., rail 23*d* FIGS. 1-4) by a clamping force applied by first and second mount portions 627, 629 and clamp 645 drawn tightly against second mount portion 629 and toward first mount portion 627 by pins, one of which is illustrated as 655, in the same manner and for the same purpose as pins 53, 55 described in connection with foregrip 10. Female cavity 647 with inwardly-facing opposed grips 649, 651 conforms with raised ridge 25 of Picatinny rail 23*d* (and rails 23*a*-23*c*) as illustrated in the example of FIGS. 25-26. Mount 613 may slide along Picatinny rail 23*d* in a forward or rearward direction (e.g., directions of arrows 65, 67 FIG. 3) before tightening pins such as pin 655.

Referring further to FIGS. 25-26 and the example of foregrip 610 illustrated therein, mount 613 provides a portion of joint 615 which engages handle 611 to mount 613. Joint 615 provides for movement of handle 611 relative to mount 613 and the firearm (e.g., firerarm 19) when movement restrictor 617 is not fully operational. In the example of FIGS. 25-26, joint 615 is a ball-and-socket-type joint including socket 689 and ball 691. Ball-and-socket-type joint 615 enables handle 611 to move in a swiveling motion relative to mount 613 and the firearm (e.g. firearm 19). Handle 611 is able to move relative to mount 613 to a plurality of different axial orientations in plural planes with the axes of all axial orientations intersecting one another at a center of rotation indicated by reference number 694 in FIG. 26.

Socket 689 of FIGS. 25-26 is illustrated as a spherical cavity 693 formed by a hemispherical first concave socket portion 695 in first mount portion 627 and a hemispherical second concave socket portion 697 in second mount portion 629. Spherical cavity 693 is formed when first and second mount portions 627, 629 are held or clamped together, for example by pins such as pins 637 with inner surfaces 631, 633 held in abutment as previously described. Spherical cavity 693 includes a surface 699 which faces ball 691 and against which ball 691 surface 703 rides when ball 691 is received in socket 689. Spherical cavity 693 further includes an edge 701 defining opening 702 through which ball 691 protrudes and which limits swiveling movement of handle 611.

In the example of FIGS. 25-26, ball 691 may not be segmented as is ball 91. Ball 691 may have a continuous surface 703.

Referring again to FIGS. 19-21, handle 611 includes handle 671 axis, handle body 673, first and second ends 675, 677, gripping portion 679, conical tapered portion 681 toward first end 675. Ball 691 is attached to handle 611. Annular ribs 685 or a tactile surface such as overmolded polymeric grip 85 with finger grips 87 as illustrated in FIG. 10A may also be provided over body 673. Representative materials for mount 613, ball 691 and handle 611 include metal, carbon fiber and composites.

In the embodiment of foregrip 610, movement restrictor 617 comprises mount 613 and sizing of socket 689 and ball 691. Socket 689 and ball 691 are sized so that when first and second mount portions 627, 629 are held together, ball 691 is clamped tightly within socket 689. Threaded pins (e.g., pin 637) which cause first and second mount portions 627, 629 to be clamped tightly together provide a type of force generator which moves the plural mount portions 627, 629 together to securely hold socket 689 against ball 691 with handle 611 at the selected axial orientation. Force applied through surface 699 of socket 689 against surface 703 of ball 691 holds ball 691, and handle 611 attached to ball 691, in the fixed position relative to mount 613 and a firearm (e.g., firearm 19). The force generated by the tightened pins (e.g., 637) against mount 613 and ultimately against ball 691 is sufficient to prevent movement of ball 691 and handle 611 until the force generated by such pins (e.g., pin 637) is relieved by loosening such pins (e.g., pin 637).

A representative range of motion of joint 615 and handle 611 relative to mount 613 and firearm (e.g., firearm 19) as provided by foregrip 610 is identical to the range of motion illustrated in FIGS. 5-6. Handle 611 supported by ball 691 has freedom to swivel to a plurality of axial orientations all having the same center of rotation 694 within ball 691. In the example, handle axis 671 extends through center of rotation 694 in all positions of handle 611. When movement restrictor 617 is not fully operative, freedom of ball 691 to swivel and move within socket 689 is limited only by contact between handle 611 and edge 701 defining socket opening 702.

Accordingly, and in the same manner as illustrated in FIGS. 5-6, handle 611 has freedom to swivel and move in a conical region of space permitting both pitch and roll movement of handle 611 relative to mount 613 and firearm (e.g., firearm 19). This swiveling movement of ball 691 within socket 689 allows handle 611 to be angled back-and-forth, side-to-side and combinations thereof providing the capability of setting handle 611 with movement restrictor 617 so that handle axis 671 is at any one position of the many potential axial orientations which is most ergonomic for that user.

The foregrip embodiments 10, 210, 410, 610 described herein are all engageable to a firearm 19 through a rail system 23, another suitable attachment system, or even as an integrated component of the firearm 19 itself. A mount 13, 213, 413, 613 engageable to a firearm 19 provides a robust attachment platform and such mounts 13, 213, 413, 613 may be engaged to firearm 19 at a position deemed ergonomic for the user.

A joint, such as a ball-and-socket joint 15, 215, 415, 615, enables handle 11, 211, 411 or 611 to be swivelled to an axial orientation most comfortable to the user and most suited to the situational use of the firearm 19. Handle 11, 211, 411, 611 can be angled as desired back-and-forth, side-to-side and combinations thereof as determined by the user.

By way of example, a neutral position of handle 11, 211, 411, 611 relative to mount 13, 213, 413, 613 and firearm 19 as illustrated in FIGS. 9-12 could be most suited to a bladed shooting stance, or for use of foregrip 10, 210, 410, 610 as a monopod to support firearm 19 on a surface during firing. For a squared shooting stance, a position of handle 11, 211, 411, 611 with handle second end 77, 277, 477, 677 both angled toward muzzle 69 and to the left of mount 13, 213, 413, 613 as illustrated in FIGS. 1-4 could be advantageously ergonomic. Foregrips 10, 210, 410, 610 advantageously provide a wide range of adjustment alternatives for the user.

Once the position and axial orientation of handle 11, 211, 411, 611 relative to mount 13, 213, 413, 613 and firearm 19 is determined, handle 11, 211, 411, 611 can be quickly held in that position by movement restrictor 17, 217, 417, 617. In the embodiments of movement restrictor 17, 217, 417, an urging force applied by spreader 117, 317, 517 on conical first end 123 of receiver 121 spreads segments 131*a*-131*d* outward with ball 91, 291, 491 surface 103, 303, 503 pressed tightly against socket 89, 289, 489 surface 99, 299, 499 to hold ball 91, 291, 491 and handle 11, 211, 411 in the selected position and axial orientation. In the embodiment of movement restrictor 617, clamping of socket bodies 571, 573 together with ball 691 oversized with respect to socket 689 holds ball 691 surface 703 tightly against socket 689 surface 699 to hold ball 691 and handle 611 in the selected position and axial orientation. The force applied by movement restrictor 17, 217, 417, 617 can be quickly removed allowing handle 11, 211, 411, 611 to be quickly repositioned at another of the axial positions and orientations.

Foregrip 10, 210, 410, 610 may be of simple construction and may be made of robust materials to ensure reliable operation under the most rigorous conditions. Materials may be chosen for other useful characteristics. For example, advanced metals, carbon fiber and composite materials may be implemented to reduce weight and provide desired strength and other physical characteristics.

While the principles of this invention have been described in connection with specific embodiments, it should be understood clearly that these descriptions are made only by way of example and are not intended to limit the scope of the invention.

The invention claimed is:

1. A multi-axis firearm foregrip comprising:

a mount engageable in a fixed position to a firearm, the mount including a socket therein;

a handle outward from the mount having a gripping portion sized for gripping by a user's hand and a handle axis;

a ball forming a ball-and-socket joint with the socket, the ball swivelling with respect to the mount and having outwardly-spreadable segments; and a pin movable in the ball co-axial with the handle axis and having one end with a spreader within the ball and an opposite end in threaded engagement with the handle, thereby allowing the handle to move to plural different axial positions by swivelling of the ball relative to the mount, whereby, rotation of the handle on the pin in a first direction around the handle axis moves the spreader toward the handle to quickly exert a force which spreads the segments outward to securely hold the ball against the socket with the handle at one of the axial positions on a first axis relative to the mount and rotation of the handle in an opposite direction around the handle axis quickly releases the force allowing the ball to swivel within the socket and the handle to be repositioned relative to the mount at another axial position on an axis different from the first axis.

2. The multi-axis firearm foregrip of claim 1 further comprising a spacer between the handle and ball and rotation of the handle in the first direction causes the pin and spreader to move with respect to the ball, thereby tightening the ball and handle against the spacer and spreading the segments.

3. The multi-axis firearm foregrip of claim 2 wherein the spacer comprises an annular bushing around the pin.

4. The multi-axis firearm foregrip of claim 1 wherein:

the segments extend longitudinally away from a pole of the ball;

each segment is separated from an adjacent segment by a longitudinal groove entirely through the ball;

the ball defines a receiver opening entirely through the ball coaxial with the handle axis and the receiver opening has a first end with a decreasing cross sectional area toward the pole;

the spreader is within the receiver opening and has an outer surface with a decreasing cross sectional area toward the pole which contacts the first end of the receiver opening; and the force is applied by movement of the spreader outer surface toward the pole and against the first end of the receiver opening to spread the segments outward.

5. The multi-axis firearm foregrip of claim 4 wherein:

the spreader and pin are coaxial with the handle axis and the pin includes a threaded first end extending through the receiver opening and past the pole; and the handle includes a threaded female opening which meshes with the threaded first end and rotation of the handle in the first direction moves the spreader toward the pole spreading the segments.

6. The multi-axis firearm foregrip of claim 5 wherein the gripping portion of the handle has a generally cylindrical shape about the handle axis.

7. The multi-axis firearm foregrip of claim 5 wherein the handle includes a gripping surface.

8. The multi-axis firearm foregrip of claim 7 wherein the handle includes a frictional gripping surface.

9. The multi-axis firearm foregrip of claim 8 wherein the frictional gripping surface is of a tactile polymeric material.

10. The multi-axis firearm foregrip of claim 1 further including:

a rail engaged with a fore-end of the firearm; and a pair of opposed grips on the mount which are engageable with the rail and which enable the foregrip to be attached and, alternatively, detached from the rail.

* * * * *